US010378357B2

(12) United States Patent
Skinner et al.

(10) Patent No.: US 10,378,357 B2
(45) Date of Patent: Aug. 13, 2019

(54) HYDRAULIC RADIAL PISTON DEVICE WITH IMPROVED PRESSURE TRANSITION MECHANISM

(71) Applicant: Eaton Intelligent Power Limited, Dublin (IE)

(72) Inventors: Jeffrey David Skinner, Madison, MS (US); Kendrick Michael Gibson, Madison, MS (US); Lawrence David Blackman, Jackson, MS (US)

(73) Assignee: Eaton Intelligent Power Limited (IE)

( * ) Notice: Subject to any disclaimer, the term of this patent is extended or adjusted under 35 U.S.C. 154(b) by 525 days.

(21) Appl. No.: 14/995,904

(22) Filed: Jan. 14, 2016

(65) Prior Publication Data

US 2016/0208610 A1 Jul. 21, 2016

Related U.S. Application Data

(60) Provisional application No. 62/105,428, filed on Jan. 20, 2015.

(51) Int. Cl.

| | |
|---|---|
| ***F01B 1/06*** | (2006.01) |
| ***F03C 1/40*** | (2006.01) |
| ***F04B 1/07*** | (2006.01) |
| ***F03C 1/047*** | (2006.01) |
| ***F04B 1/047*** | (2006.01) |
| ***F04B 1/107*** | (2006.01) |
| ***F04B 49/12*** | (2006.01) |

(52) U.S. Cl.

CPC ..... *F01B 1/0689* (2013.01); *F01B 1/061* (2013.01); *F03C 1/046* (2013.01); *F03C 1/047* (2013.01); *F04B 1/047* (2013.01); *F04B 1/07* (2013.01); *F04B 1/107* (2013.01); *F04B 1/1071* (2013.01); *F04B 49/123* (2013.01)

(58) Field of Classification Search

CPC ..... F04B 49/123; F04B 1/043; F04B 1/047; F04B 1/07; F04B 1/107; F04B 1/1071; F01B 1/0689; F01B 1/061; F03C 1/046; F03C 1/047; F04C 14/226; F04C 14/223

USPC ..... 417/219, 497, 220, 273; 418/30

See application file for complete search history.

(56) References Cited

U.S. PATENT DOCUMENTS

| | | | | |
|---|---|---|---|---|
| 3,610,106 A | | 10/1971 | Cavalieri | |
| 4,920,859 A | | 5/1990 | Smart et al. | |
| 5,249,512 A | | 10/1993 | Christenson | |
| 5,482,442 A | * | 1/1996 | Blair | F04B 1/1133 417/220 |
| 5,634,777 A | | 6/1997 | Albertin et al. | |

(Continued)

OTHER PUBLICATIONS

European Search Report for Application No. 16151663.8 dated Jun. 14, 2016.

*Primary Examiner* — Kenneth J Hansen
*Assistant Examiner* — Benjamin Doyle
(74) *Attorney, Agent, or Firm* — Merchant & Gould P.C.

(57) ABSTRACT

A hydraulic radial piston device is provided with a mechanism for reducing pressure pulsations and providing a smooth pressure transition throughout different displacement operations. In certain examples, the hydraulic radial piston device is configured to maintain an amount of pre-compression and an amount of decompression of hydraulic fluid trapped in a cylinder chamber to be consistent, respectively, throughout different displacement operations.

21 Claims, 11 Drawing Sheets

(56) References Cited

U.S. PATENT DOCUMENTS

| | | | | |
|---|---|---|---|---|
| 5,651,301 | A * | 7/1997 | Thoma | F04B 1/07 417/219 |
| 5,865,087 | A | 2/1999 | Olson | |
| 6,010,311 | A * | 1/2000 | Thoma | F04B 1/07 417/219 |
| 2010/0303660 | A1 | 12/2010 | Konishi et al. | |

* cited by examiner

HYDRAULIC RADIAL PISTON DEVICE WITH IMPROVED PRESSURE TRANSITION MECHANISM

CROSS-REFERENCE TO RELATED APPLICATION(S)

This application claims the benefit of U.S. Patent Application Ser. No. 62/105,428, titled HYDRAULIC RADIAL PISTON DEVICE WITH IMPROVED PRESSURE TRANSITION MECHANISM, filed Jan. 20, 2015, the disclosure of which is hereby incorporated by reference in its entirety.

BACKGROUND

Radial piston devices (either pumps or motors) are often used in aerospace hydraulic applications and are characterized by a rotor rotatably engaged with a pintle. The rotor has a number of radially oriented cylinders disposed around the rotor and supports a number of pistons in the cylinders. A head of each piston contacts an outer thrust ring that is not axially aligned with the rotor. A stroke of each piston is determined by the eccentricity of the thrust ring with respect to the rotor. When the device is in a pump configuration, the rotor can be rotated by operation of a drive shaft associated with the rotor. The rotating rotor draws hydraulic fluid into the pintle and forces the fluid outward into a first set of the cylinders so that the pistons are displaced outwardly within the first set of the cylinders. As the rotor further rotates around the pintle, the first set of the cylinders becomes in fluid communication with the outlet of the device and the thrust ring pushes back the pistons inwardly within the first set of the cylinders. As a result, the fluid drawn into the first set of the cylinders is displaced into the outlet of the device through the pintle.

Radial piston devices include various passages that form a variable orifice between pumping elements and inlet and outlet ports. At least some of the passages are configured to alternatingly open and closed as the rotor rotates to pump hydraulic fluid. The design of the passages can modify the timing at which the passages are open and closed in the operation of the devices. Suboptimal timing design can increase a chance of pressure pulsations and/or cavitation, thereby decreasing efficiency of the devices.

SUMMARY

In general terms, this disclosure is directed to a hydraulic radial piston device that provides a smooth pressure transition. In one possible configuration and by non-limiting example, the hydraulic radial piston device may include a mechanism for reducing pressure pulsations for different displacement operations.

In certain examples, a hydraulic radial piston device in accordance with the present disclosure provides an optimal timing design that allows a smooth pressure transition in pistons reciprocating in the device. In general, the hydraulic radial piston device is configured to allow an amount of precompression and an amount of decompression of hydraulic fluid to be consistent, respectively, throughout a range of displacement rates. In some examples, the phase of a stroke curve defined by the motion of the pistons reciprocating within cylinders defined in a rotor is shifted such that levels of precompression and decompression of hydraulic fluid trapped in a cylinder chamber are generally consistent throughout a range of displacement rates of the radial piston device.

In certain examples, a hydraulic radial piston device includes a housing, a pintle shaft, a rotor, a plurality of pistons, a thrust ring, and a ring displacement mechanism. The housing may have a hydraulic fluid inlet and a hydraulic fluid outlet. The pintle shaft is fixed within the housing and defines a pintle inlet and a pintle outlet. The pintle inlet is in fluid communication with the hydraulic fluid inlet, and the pintle outlet is in fluid communication with the hydraulic fluid outlet. The rotor is mounted on the pintle shaft and configured to rotate relative to the pintle shaft about a rotor axis of rotation. The rotor axis of rotation extends through a length of the pintle shaft. The rotor defines a plurality of radially oriented cylinders and a plurality of rotor fluid ports. Each of the plurality of rotor fluid ports is in fluid communication with at least one of the plurality of radially oriented cylinders and is alternatively in fluid communication with either the pintle inlet or the pintle outlet as the rotor rotates relative to the pintle shaft about the rotor axis of rotation. The plurality of pistons is received in the plurality of radially oriented cylinders, respectively. The thrust ring is disposed about the rotor and has a thrust ring axis of rotation. The thrust ring is in contact with the plurality of pistons and configured to rotate about the thrust ring axis of rotation as the rotor rotates relative to the pintle shaft about the rotor axis of rotation. The ring displacement mechanism is configured to move the thrust ring through a range of movement within the housing between a first position in which the radial piston device is in a minimum displacement operation (i.e., where the radial piston device provides a minimum displacement of hydraulic fluid per each rotation of the rotor) and a second position in which the radial piston device is in a maximum displacement operation (i.e., where the radial piston device provides a maximum displacement of hydraulic fluid per each rotation or the rotor). The ring displacement mechanism can maintain the thrust ring axis of rotation to be offset relative to the rotor axis of rotation throughout the range of movement within the housing.

In certain examples, the pintle inlet and the pintle outlet are oppositely arranged around the pintle shaft to define a first reference line extending through the pintle inlet and the pintle outlet and intersecting the rotor axis of rotation. An offset reference line is defined as a line extending through the rotor axis of rotation and the thrust ring axis of rotation being offset from the rotor axis of rotation throughout the different positions within the housing. Thus, the offset reference line is a line corresponding to a direction of eccentricity of the thrust ring relative to the rotor. The offset reference line is aligned with the first reference line when the thrust ring is in the first position. The ring displacement mechanism may adjust a position of the thrust ring within the housing for different displacement operations such that the offset reference line pivots about the rotor axis of rotation.

In certain examples, an eccentricity reference line is defined through the rotor axis of rotation and the thrust ring axis of rotation. The eccentricity reference line may rotate about the rotor axis of rotation as the thrust ring is moved through the range of movement. A position of the thrust ring may be adjusted along the range of movement to change a volume of hydraulic fluid displaced by the radial piston device for each rotation of the rotor by moving the thrust ring axis of rotation further from the rotor axis of rotation as the thrust ring is moved toward the second position so as to increase a stroke length of the pistons within the cylinders, and by moving the thrust ring axis of rotation closer to the rotor axis of rotation as the thrust ring is moved toward the first position so as to decrease a stroke length of the pistons within the cylinders. Movement of the pistons within the cylinders can define a stroke length curve corresponding to one full rotation of the rotor, and the stroke length curve is shifted relative to the fluid inlet section, the fluid outlet section, the fluid precompression section, and the fluid decompression section of the pintle shaft as the thrust ring is moved along the range of movement. In certain examples, the stroke length curve is shifted such that a distance of movement of the pistons within the cylinders as the rotor fluid ports move across the fluid precompression section remains substantially constant as the thrust ring is moved through the range of movement, and a distance of movement of pistons within the cylinders as the rotor fluid ports move across the fluid decompression section remains substantially constant as the thrust ring is move through the range of movement.

The above features and advantages and other features and advantages of the present teachings are readily apparent from the following detailed description of the best modes for carrying out the present teachings when taken in connection with the accompanying drawings.

DETAILED DESCRIPTION

Figure 1A:
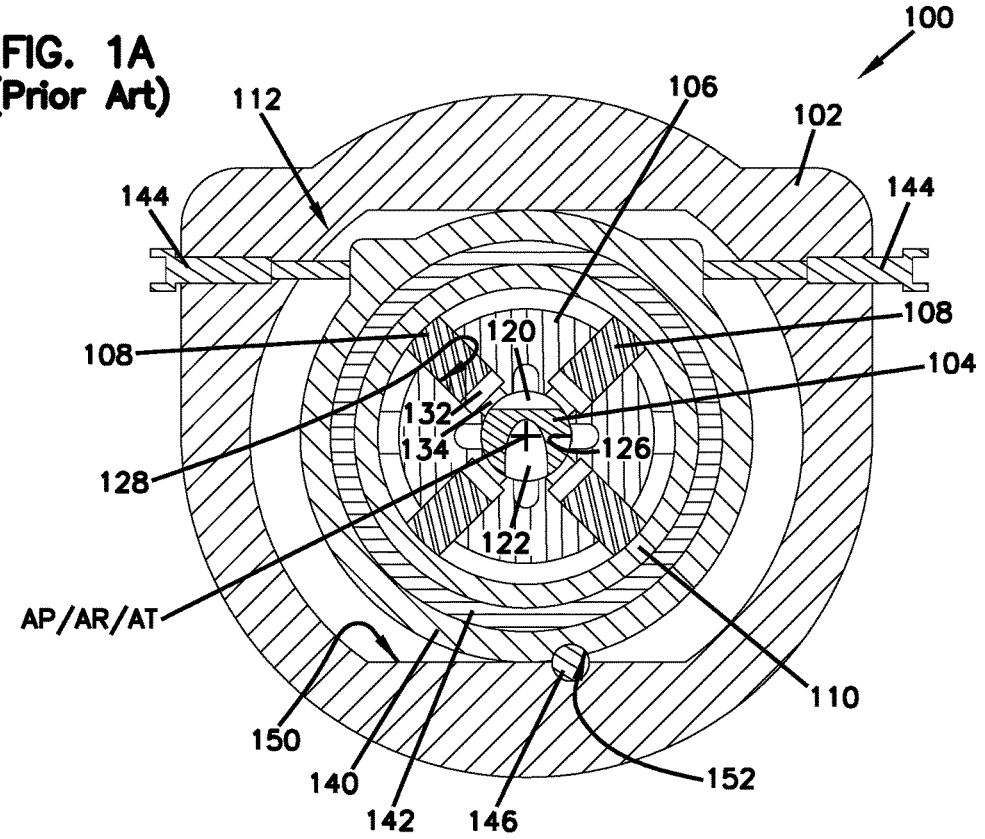
FIG. 1A (Prior Art)
FIG. 1A illustrates a hydraulic radial piston device in a minimum displacement operation.

Various examples will be described in detail with reference to the drawings, wherein like reference numerals represent like parts and assemblies throughout the several views.

In the present disclosure, radial piston devices are described generally. These devices may be used in both motor and pump applications, as required. Certain differences between motor and pump applications are described herein when appropriate, but additional differences and similarities would also be apparent to a person of skill in the art. Although the technology herein is described in the context of radial piston devices, the benefits of the technologies described may also be applicable to any device in which the pistons are oriented between an axial position and a radial position.

Figure 1B:
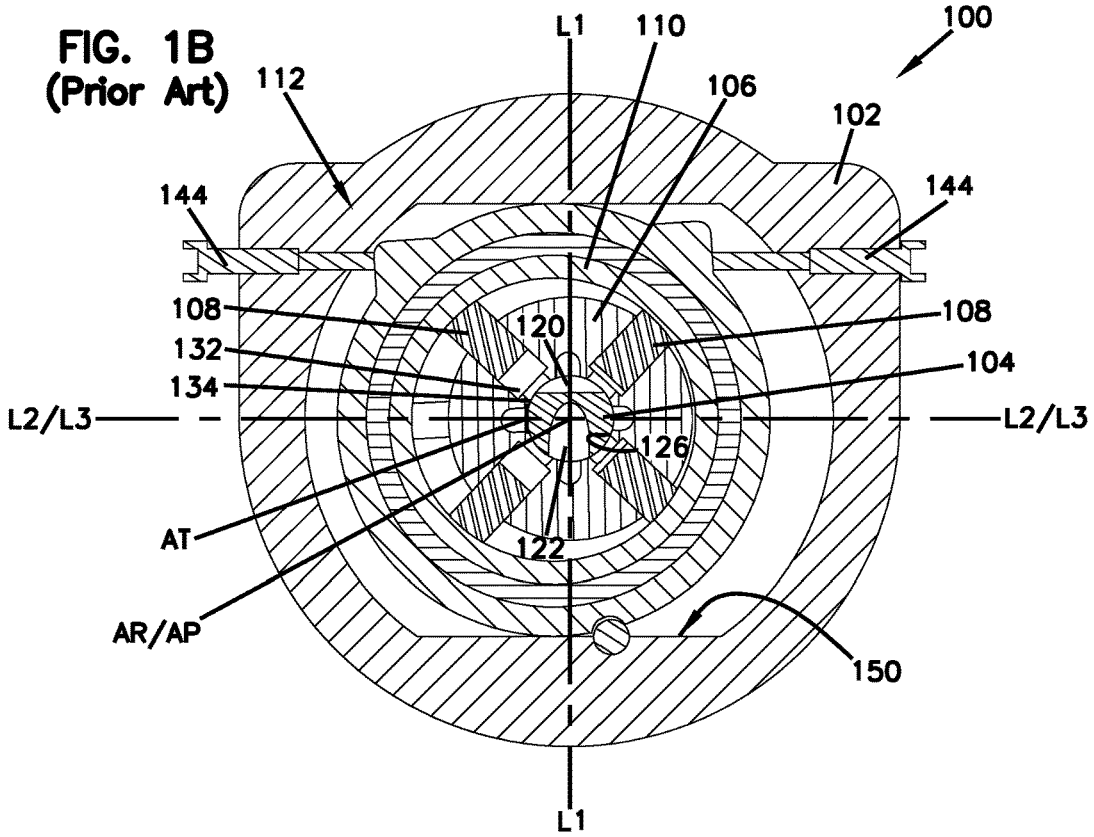
FIG. 1B (Prior Art)
FIG. 1B illustrates the hydraulic radial piston device in a maximum displacement operation.
Figure 2:
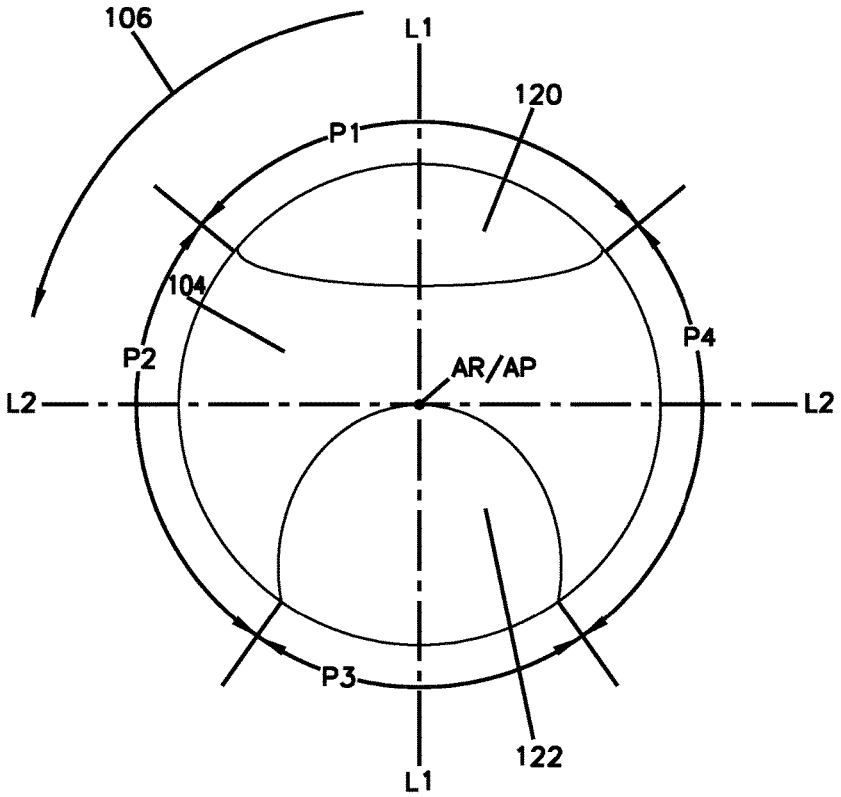
FIG. 2 (Prior Art)
FIG. 2 illustrates an example pintle shaft employed in the hydraulic radial piston device.

Referring to FIGS. 1-2, an example structure and operation of a hydraulic radial piston device 100 is described without adjustment of piston motion in accordance with the principles of the present disclosure.

FIGS. 1A-1B are side cross-sectional views of an example hydraulic radial piston device 100 in different operations. In particular, FIG. 1A illustrates that the hydraulic radial piston device 100 is in a minimum displacement operation, in which the device 100 operates to pump a minimum amount of hydraulic fluid therethough. In some examples, in the minimum displacement operation, the device 100 can be configured to pump no hydraulic fluid therethrough. FIG. 1B illustrates that the radial piston device 100 is in a maximum displacement operation (also referred to herein as a full displacement operation), in which the device 100 operates to pump hydraulic fluid in its full capacity. As described herein, the radial piston device 100 can gradually change its operations between the minimum displacement operation and the maximum displacement operation.

In some examples, the radial piston device 100 includes a housing 102, a pintle shaft 104, a rotor 106, a plurality of pistons 108, a thrust ring 110, and a ring displacement mechanism 112.

The radial piston device 100 may be used as a hydraulic pump or a hydraulic motor. When the radial piston device 100 operates as a pump, torque is input to a drive shaft that is coupled to the rotor 106 to rotate the rotor 106 around the pintle shaft 104.

The housing 102 is configured to receive various parts of the device 100, including the pintle shaft 104, the rotor 106, the pistons 108, the thrust ring 110, and the ring displacement mechanism 112. The housing 102 includes a hydraulic fluid inlet through which hydraulic fluid is drawn into the housing 102 when the device 100 operates as a pump. The housing 102 further includes a hydraulic fluid outlet through which the hydraulic fluid is discharged from the housing 102 when the device 100 operates as a pump.

The pintle shaft 104 is fixed within the housing 102 and extends along a pintle axis $A_P$ within the housing 102. The pintle axis $A_P$ extends through a length of the housing 102. The pintle shaft 104 defines a pintle inlet 120 and a pintle outlet 122. The pintle inlet 120 is in fluid communication with the hydraulic fluid inlet to draw hydraulic fluid therefrom, and the pintle outlet 122 is in fluid communication with the hydraulic fluid outlet to discharge the hydraulic fluid thereto. As described herein, the hydraulic fluid drawn from the hydraulic fluid inlet through the pintle inlet 120 is delivered into a chamber defined by a cylinder of the rotor 106 and a piston reciprocating within the cylinder during a fluid inlet stage, compressed during a precompression stage, discharged from the chamber to the hydraulic fluid outlet through the pintle outlet 122 during a fluid outlet stage, and decompressed during a decompression stage. In some examples, the pintle inlet 120 and the pintle outlet 122 are arranged oppositely on the pintle shaft 104 and aligned with the pintle axis $A_P$. The pintle inlet 120 and the pintle outlet 122 can be spaced apart 180 degrees around the pintle shaft 104 to define a first reference line L1 extending through the pintle inlet 120 and the pintle outlet 122 and intersecting the pintle axis $A_P$. For example, the center of the pintle inlet 120 is apart 180 degrees from the center of the pintle outlet 122 around the pintle shaft 104 such that the first reference line L1 intersecting the centers of the pintle inlet 120 and the pintle outlet 122 lies on the pintle axis $A_P$.

The rotor 106 defines a bore 126 that allows the rotor 106 to be mounted on the pintle shaft 104. The rotor 106 has a rotor axis of rotation $A_R$ that extends through a length of the pintle shaft 104 so as to be coaxial with the pintle axis $A_P$. In some examples, the rotor 106 is coupled to a drive shaft that delivers torque to the rotor 106 so that the rotor 106 rotates on the pintle shaft 104 about the rotor axis of rotation $A_R$. The rotor 106 defines a plurality of radial cylinders 128 configured to receive the plurality of pistons 108, respectively. Each piston 108 is configured to reciprocate within the associated radial cylinder 128 as the rotor 106 rotates on the pintle shaft 104 with the thrust ring 110 displaced, as described below. Each of the pistons 108 defines a chamber 132 within the associated cylinder 128 to draw hydraulic fluid through the pintle inlet 120 and discharge the hydraulic fluid through the pintle outlet 122. Accordingly, a volume of the chamber 132 varies as the piston 108 reciprocates within the cylinder 128. The rotor 106 defines a plurality of rotor fluid ports 134, each of which is arranged below each set of radial cylinder 128 and piston 108. Each of the rotor fluid ports 134 can be in fluid communication with each chamber 132 defined by each set of radial cylinder 128 and piston 108. Each of the rotor fluid ports 134 is alternatively in fluid communication with either the pintle inlet 120 of the pintle shaft 104 or the pintle outlet 122 of the pintle shaft 104, depending on a rotational position of the rotor 106 relative to the pintle shaft 104 about the rotor axis of rotation $A_R$. In the example illustrations of FIGS. 1A, 1B, 2, 5A, 5B, 6A, and 6B, the rotor 106 can rotate counter-clockwise when the device 100 operates as a pump. This direction of rotor rotation aligns with the piston motion that is from left to right in the example illustrates of FIGS. 3A, 3B, 4A, 4B, and 4C.

The pistons 108 are received in the radial cylinders 128 defined in the rotor 106 and displaceable in the radial cylinders 128, respectively. Each piston 108 is configured to contact an inner surface of the thrust ring 110 at a head portion of the piston 108.

The thrust ring 110 is radially supported by the housing 102 so as rotate within the housing 102. The thrust ring 110 is disposed around the rotor 106 and has a thrust ring axis of rotation $A_T$. The thrust ring 110 (e.g., an inner surface thereof) is arranged and configured to contact with the plurality of pistons 108 (e.g., the head portions thereof) and rotate about the thrust ring axis of rotation $A_T$ as the rotor 106 rotates on the pintle shaft 104 about the rotor axis of rotation $A_R$.

The ring displacement mechanism 112 operates to move the thrust ring 110 through a range of movement within the housing 102 such that the thrust ring axis of rotation $A_T$ is offset from the rotor axis of rotation $A_R$ in operation. Depending on the displacement of the thrust ring 110 relative to the pintle shaft 104 and the rotor 106, different flow rates of hydraulic fluid can be produced per each rotation of the rotor 106, as described below.

In some examples, the ring displacement mechanism 112 includes a cam ring 140, a bearing element 142, a control device 144, and an anti-slip element 146.

The cam ring 140 is disposed radially around the thrust ring 110 and defines a space configured to at least partially receive and rotatably support the thrust ring 110. The thrust ring 110 can rotate about the thrust ring axis of rotation $A_T$ relative to the cam ring 140.

The bearing element 142 can be disposed between the thrust ring 110 and the cam ring 140 to ensure the rotation of the thrust ring 110 relative to the cam ring 140. In some examples, the bearing element 142 is configured as a ring made of brass and interference-fitted (e.g., press-fitted) to the inner surface of the cam ring 140. In this configuration, the thrust ring 110 can slide on the inner surface of the bearing element 142 as it rotates about the thrust ring axis of rotation $A_T$.

The control device 144 operates to adjust a position of the cam ring 140 within the housing 102. In the illustrated example, the control device 144 can displace the cam ring 140 within the housing 102 such that the thrust ring axis of rotation $A_T$ is offset from the rotor axis of rotation $A_R$. As illustrated in FIGS. 1A-1B, the control device 144 can move the cam ring 140 along a second reference line L2 that is perpendicular to the first reference line L1 and passes the rotor axis of rotation $A_R$. As described in FIG. 2, the second reference line L2 can be defined as a line extending through a precompression section P2 and a decompression section P4 of the pintle shaft 104 and intersecting the pintle axis $A_P$ or the rotor axis of rotation $A_R$. In some examples, the control device 144 operates the cam ring 140 to roll on an inner surface 150 of the housing 102 to shift the thrust ring axis of rotation $A_T$ from the rotor axis of rotation $A_R$ along the second reference line L2.

The anti-slip element 146 operates to prevent the cam ring 140 from slipping on the inner surface 150 of the housing 102 as the cam ring 140 rolls thereon by the operation of the control device 144. In some examples, the anti-slip element 146 is a pin configured to engage a groove 152 formed on the outer surface of the cam ring 140.

It should be understood by those skilled in the art that the hydraulic radial piston device 100 can include additional or alternative components or parts. Further, the hydraulic radial piston device 100 can be configured in different manners from those described herein. In some examples, the hydraulic radial piston device 100 can include at least some of the features disclosed in the PCT Application No. PCT/US2013/050104, filed Jul. 11, 2013, and the PCT Application No. PCT/US2014/072766, filed Dec. 30, 2014, the entireties of which are incorporated hereby in reference.

Referring to FIG. 1A, the radial piston device 100 is in the minimum displacement operation. In the minimum displacement operation, the radial piston device 100 provides a minimum displacement of hydraulic fluid in each cycle (i.e., per each rotation of the rotor 106). In some examples, the minimum displacement operation can provide essentially zero displacement of hydraulic fluid. In the minimum displacement operation, the ring displacement mechanism 112 operates to maintain the thrust ring 110 in a first position within the housing 102. When the thrust ring 110 is in the first position, the thrust ring 110 is arranged coaxially with the rotor 106 so that the thrust ring axis of rotation $A_T$ matches the rotor axis of rotation $A_R$. In the first position for the minimum displacement operation, each of the pistons 108 does not change its position within the associated cylinder 128 of the rotor 106 as the rotor 106 rotates on the pintle shaft 104, and, therefore, no hydraulic fluid is pumped by the device 100.

Referring to FIG. 1B, the radial piston device 100 is in the maximum displacement operation (e.g., the full displacement operation). In the maximum displacement operation, the radial piston device 100 provides a maximum displacement of hydraulic fluid in each cycle (i.e., per each rotation of the 106). In the maximum displacement operation, the ring displacement mechanism 112 operates to move the thrust ring 110 into a second position. When in the second position for the maximum displacement operation, the thrust ring 110 is offset from the first position along the second reference line L2 such that the device 100 operates to pump hydraulic fluid in its full capacity. For example, the thrust ring 110 is displaced relative to the rotor 106 such that the thrust ring axis of rotation $A_T$ is offset from the rotor axis of rotation $A_R$ in its maximum displacement along the second reference line L2. In other words, the thrust ring 110 moves along the second reference line L2 relative to the rotor 106 to define an offset reference line L3 extending through the thrust ring axis of rotation $A_T$ and the rotor axis of rotation $A_R$ and intersecting the rotor axis of rotation $A_R$, and the offset reference line L3 is aligned with the second reference line L2.

The ring displacement mechanism 112 can operate to gradually change the flow rate of the radial piston device 100 between the minimum displacement operation (FIG. 1A) and the maximum displacement operation (FIG. 1B) by gradually displacing the thrust ring 110 between the first position (FIG. 1A) and the second position (FIG. 1B). For example, when the radial piston device 100 is in a half displacement operation in which the device 100 operates to pump hydraulic fluid in half of its full capacity, the ring displacement mechanism 112 operates to move the thrust ring 110 into a position in which the thrust ring 110 is moved relative to the rotor 106 such that the thrust ring axis of rotation $A_T$ is offset from the rotor axis of rotation $A_R$ along the second reference line L2 half of its maximum displacement therealong. The offset reference line L3 defined by the offset of the thrust ring 110 relative to the rotor 106 (and the pintle shaft 104) remains aligned with the second reference line L2 throughout different displacement operations between the minimum displacement operation and the maximum displacement operation.

Referring again to FIG. 2, the pintle shaft 104 can be divided into four sections around its circumference on which each of the rotor fluid ports 134 passes as the rotor 106 rotates on the pintle shaft 104 about the rotor axis of rotation $A_R$. For example, the pintle shaft 104 has a fluid inlet section P1, a fluid precompression section P2, a fluid outlet section P3, and a fluid decompression section P4. The fluid inlet section P1 is defined as a portion of the pintle shaft 104 that is open through the pintle inlet 120, and the fluid outlet section P3 is defined as a portion of the pintle shaft 104 that is open through the pintle outlet 122. The precompression section P2 is defined as a region between the fluid inlet section P1 and the fluid outlet section P3, over which each rotor fluid port 134 of the rotor 106 passes from the fluid inlet section P1 to the fluid outlet section P3 as the rotor 106 rotates on the pintle shaft 104. The decompression section P4 is defined as a region between the fluid outlet section P3 and the fluid inlet section P1, over which each rotor fluid port 134 of the rotor 106 passes from the fluid outlet section P3 to the fluid inlet section P1 as the rotor 106 rotates on the pintle shaft 104.

The design of the sections P1-P4 (including the pintle inlet 120 and the pintle outlet 122) can determine a timing at which each chamber 132 defined by each set of piston 108 and cylinder 128 is open or closed through the pintle inlet 120 or the pintle outlet 122 as the rotor 106 rotates when the device 100 is in operation. As described herein, the timing design of the radial piston device 100 in accordance with the present disclosure can provide a smooth pressure transition of each set of piston 108 and cylinder 128 around the pintle shaft 104.

Figure 3A:
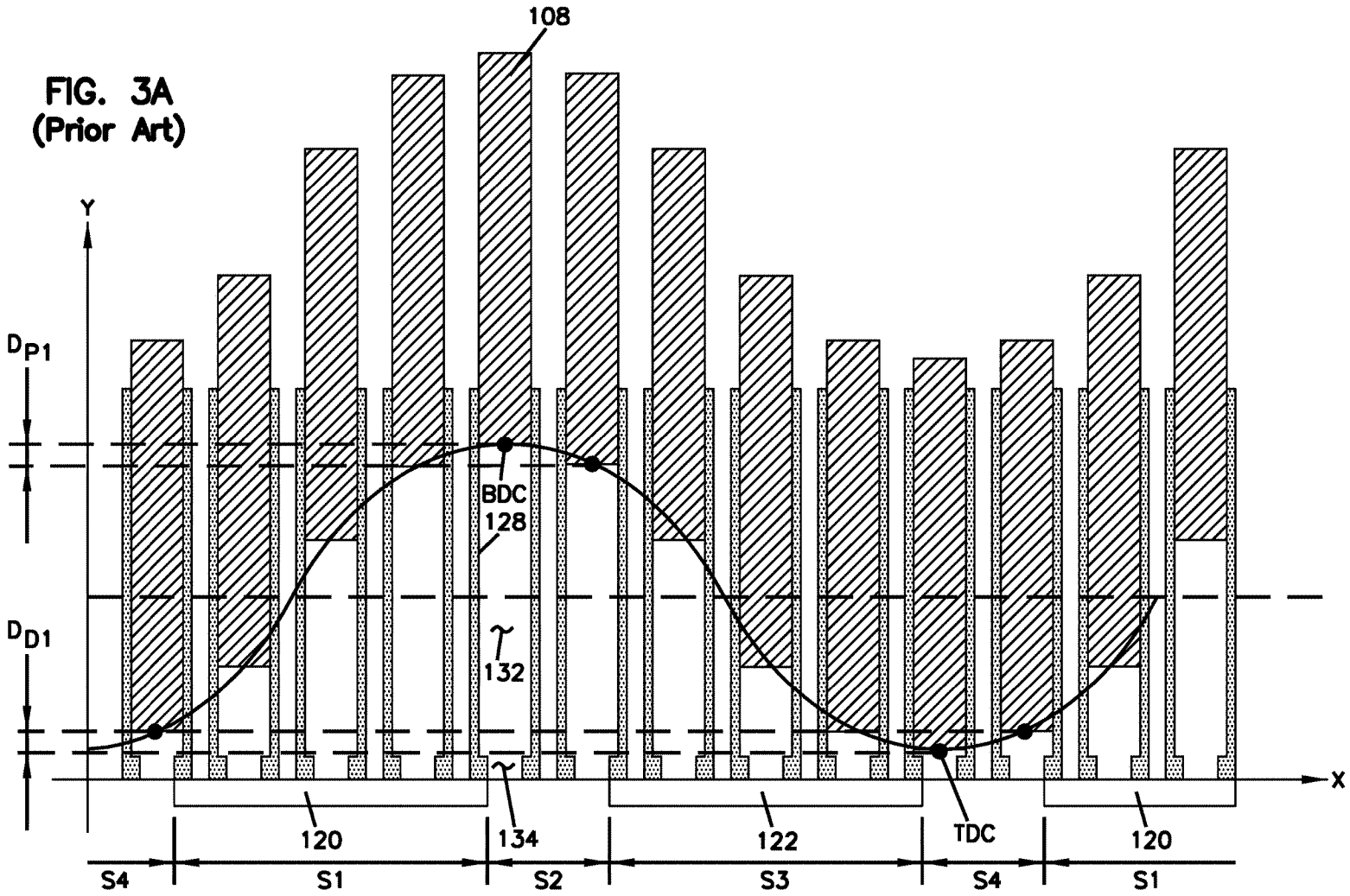
FIG. 3A (Prior Art)
FIG. 3A illustrates an example stroke of each piston within an associated cylinder as a rotor rotates on the pintle shaft in the maximum displacement operation.
Figure 3B:
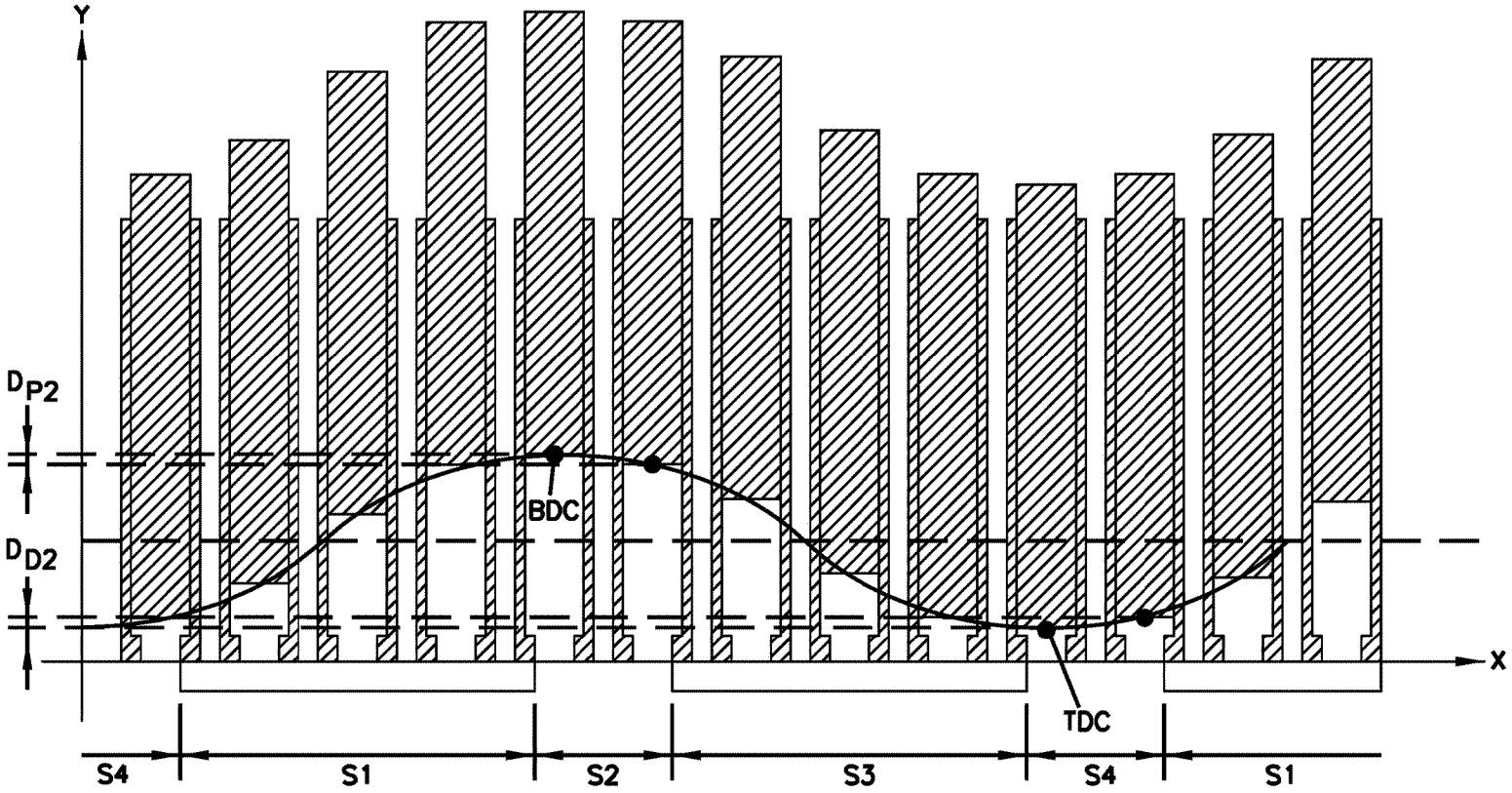
FIG. 3B (Prior Art)
FIG. 3B illustrates an example stroke of each piston within an associated cylinder as the rotor rotates on the pintle shaft in a half displacement operation.
Figure 3C:
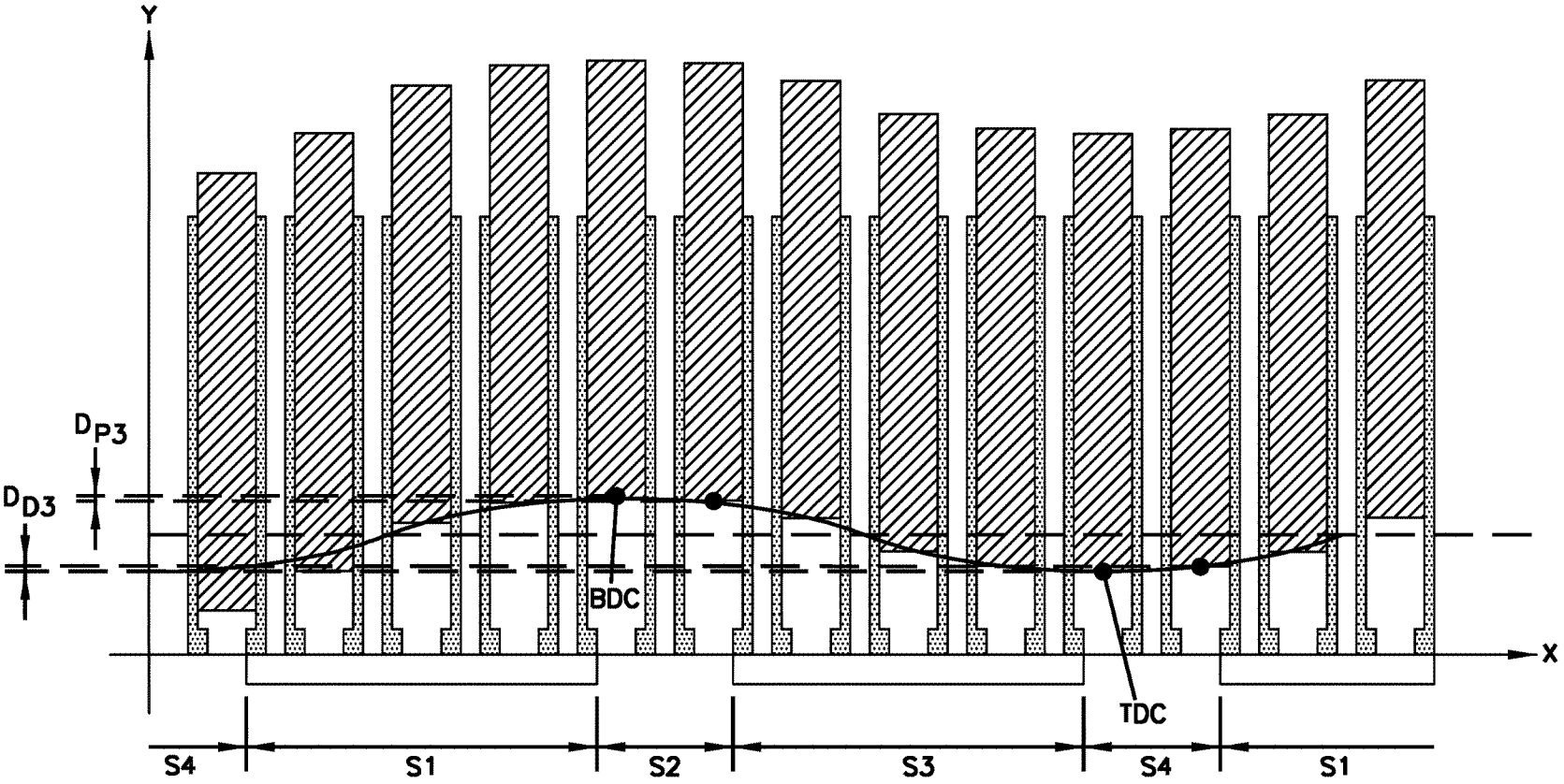
FIG. 3C (Prior Art)
FIG. 3C illustrates an example stroke of each piston within an associated cylinder as the rotor rotates on the pintle shaft in a displacement operation less than the half displacement operation.

Referring to FIGS. 3A-3C, example strokes of each piston 108 within an associated cylinder 128 of the rotor 106 are illustrated as the rotor 106 rotates on the pintle shaft 104 about the rotor axis of rotation $A_R$. As described above, when the thrust ring 110 is in a position other than the first position (i.e., when the radial piston device 100 is in an operation other than the minimum displacement operation), the thrust ring axis of rotation $A_T$ is offset from the rotor axis of rotation $A_R$ such that each of the pistons 108 radially reciprocates within the associated cylinder 128 as the rotor 106 rotates on the pintle shaft 104 about the rotor axis of rotation $A_R$. As described below, each piston 108 repeatedly goes through a fluid inlet stage, a precompression stage, a fluid outlet stage, and a decompression stage as the rotor 106 rotates on the pintle shaft 104.

FIG. 3A illustrates a relative position of each piston 108 within an associated cylinder 128 as the rotor 106 rotates on the pintle shaft 104 about the rotor axis of rotation $A_R$ when the device 100 is in the maximum displacement operation (i.e., the thrust ring 110 is in the second position). As illustrated, each of the pistons 108 passes a fluid inlet stage S1, a precompression stage S2, a fluid outlet stage S3, and a decompression stage S4 as the rotor 106 rotates on the pintle shaft 104. The piston 108 is in the fluid inlet stage S1 when the corresponding rotor fluid port 134 of the rotor 106 travels over the fluid inlet section P1 of the pintle shaft 104 to draw hydraulic fluid into the chamber 132 of the corresponding cylinder 128 through the pintle inlet 120. The piston 108 is in the precompression stage S2 when the corresponding rotor fluid port 134 of the rotor 106 travels over the precompression section P2 of the pintle shaft 104. In the precompression stage S2, the rotor fluid port 134 is closed by the outer surface (i.e., the precompression section P2) of the pintle shaft 104, and therefore, the hydraulic fluid is contained (e.g., trapped) and compressed within the chamber 132 until the rotor fluid port 134 moves to the fluid outlet section P3 of the pintle shaft 104 to become in fluid communication with the pintle outlet 122 thereof (i.e., the fluid outlet stage S3). In the fluid outlet stage S3, the rotor fluid port 134 of the rotor 106 moves to the fluid outlet section P3 of the pintle shaft 104 to discharge at least a portion of the hydraulic fluid from the chamber 132 through the pintle outlet 122. The piston 108 is in the decompression stage S4 when the corresponding rotor fluid port 134 of the rotor 106 travels over the decompression section P4 of the pintle shaft 104. In the decompression stage S4, the rotor fluid port 134 is closed by the outer surface (i.e., the decompression section P4) of the pintle shaft 104, and therefore, the hydraulic fluid left in the chamber 132 remains contained (e.g., trapped) in the chamber 132 and decompressed therewithin as the rotor 106 rotates on the pintle shaft 104 until the rotor fluid port 134 moves to the fluid inlet section P1 of the pintle shaft 104 to become in fluid communication with the pintle inlet 120 thereof (i.e., the fluid inlet stage S1). As the rotor 106 rotates one turn (360 degrees), the four stages S1-S4 are complete. As the rotor 106 continues to rotate on the pintle shaft 104 about the rotor axis of rotation $A_R$, the four stages S1, S2, S3 and S4 are repeated in order to pump hydraulic fluid through the device 100.

With continued reference to FIG. 3A, an example stroke of each piston 108 within the cylinder 128 is depicted as the rotor 106 rotates on the pintle shaft 104 when the device 100 is in the maximum displacement operation. The graph depicted in FIG. 3A shows a stroke length curve defined by the motion of one of the pistons 108 within its associated cylinder 128 relative to the pintle shaft 104 when the device 100 is adjusted to the maximum displacement operation. The horizontal axis (X) of the graph indicates a position of a set of piston 108 and cylinder 128 relative to the pintle shaft 104 during the rotation of the rotor 106, and the vertical axis (Y) of the graph indicates a position of the piston 108 within the cylinder 128 to define the chamber 132 therewithin. The vertical axis of the graph can also indicate a volume of the chamber 132. It is noted that the graph and the relative positions of the piston 108 are somewhat exaggerated in FIGS. 3A-3C for clarity purposes.

As the rotor 106 goes through the fluid inlet stage S1 (i.e., the set of piston 108 and cylinder 128 with the rotor fluid port 134 moves on the fluid inlet section P1 of the pintle shaft 104), the rotor fluid port 134 is in fluid communication with the pintle inlet 120 and the piston 108 gradually extends within the cylinder 128 to draw hydraulic fluid from the pintle inlet 120 into the gradually extending chamber 132.

As the rotor 106 moves into the precompression stage S2 (i.e., the set of piston 108 and cylinder 128 with the rotor fluid port 134 moves on the precompression section P2 of the pintle shaft 104), the rotor fluid port 134 is closed by the outer surface of the pintle shaft 104 and the hydraulic fluid drawn into the chamber 132 is trapped therein. As illustrated, the piston 108 is fully extended (i.e., at bottom dead center (BDC) position) within the cylinder 128 to make the full volume of the chamber 132 as soon as the rotor fluid port 134 is closed to trap the hydraulic fluid therein at the precompression stage S2. Then, the piston 108 gradually retracts within the cylinder 128 to compress the trapped hydraulic fluid therewithin as the rotor 106 rotates during the precompression stage S2 until the rotor 106 enters the fluid outlet stage S3. The extent to which the trapped hydraulic fluid is compressed during the precompression stage S2 in the maximum displacement operation is denoted as a full flow precompression distance $D_{P1}$.

As the rotor 106 goes through the fluid outlet stage S3 (i.e., the set of piston 108 and cylinder 128 with the rotor fluid port 134 moves on the fluid outlet section P3 of the pintle shaft 104), the rotor fluid port 134 is in fluid communication with the pintle outlet 122 and the piston 108 gradually retracts within the cylinder 128 to discharge the hydraulic fluid from the gradually retracting chamber 132 through the pintle outlet 122.

As the rotor 106 moves into the decompression stage S4 (i.e., the set of piston 108 and cylinder 128 with the rotor fluid port 134 moves on the decompression section P4 of the pintle shaft 104), the rotor fluid port 134 is closed by the outer surface of the pintle shaft 104 and the hydraulic fluid left within the chamber 132 is trapped therein. In some examples, there is no hydraulic fluid left within the chamber 132 during the decompression stage S4. As illustrated, the piston 108 is fully retracted (i.e., at top dead center (TDC) position) within the cylinder 128 to make the minimum volume of the chamber 132 as soon as the rotor fluid port 134 is closed to trap the remaining hydraulic fluid therein at the decompression stage S4. Then, the piston 108 gradually extends within the cylinder 128 to decompress the chamber 132 (and the trapped hydraulic fluid therewithin) as the rotor 106 rotates during the decompression stage S4 until the rotor 106 enters the fluid inlet stage S1. The extent to which the chamber 132 and the trapped hydraulic fluid therewithin (if any) are compressed during the decompression stage S4 in the maximum displacement operation is denoted as a full flow decompression distance $D_{D1}$. After the decompression stage S4, the rotor 106 enters again the fluid inlet stage S1 and the four stages S1-S4 are repeated as the rotor 106 continues to rotate on the pintle shaft 104.

Similarly to FIG. 3A, FIG. 3B illustrates a relative position of each piston 108 within an associated cylinder 128 as the rotor 106 rotates on the pintle shaft 104 about the rotor axis of rotation $A_R$ when the device 100 is in the half displacement operation (i.e., the thrust ring 110 is in the half way between the first and second positions), and FIG. 3C illustrates a relative position of the piston 108 within the cylinder 128 as the rotor 106 rotates on the pintle shaft 104 about the rotor axis of rotation $A_R$ when the device 100 is in a displacement operation less than the half displacement operation. For example, the device 100 is in 5% operation in which the thrust ring 110 is displaced 5% of the maximum allowable displacement from the minimum displacement position. In FIGS. 3B and 3C, the piston 108 reciprocates within the cylinder 128 similarly to that of FIG. 3A except that the amount of displacement of the piston 108 is smaller than that of FIG. 3A. Further, the extent to which the trapped hydraulic fluid is compressed during the precompression stage S2 in the half displacement operation (which is referred to herein as a half flow precompression distance $D_{P2}$) is different from the full flow precompression distance $D_{P1}$. Similarly, the extent to which the trapped hydraulic fluid is compressed during the precompression stage S2 in the 5% displacement operation (which is referred to herein as a 5% flow precompression distance $D_{P3}$) is also different from the full flow precompression distance $D_{P1}$ and the half flow precompression distance $D_{P2}$. Also, the extent to which the trapped hydraulic fluid is compressed during the decompression stage S3 in the half displacement operation (which is referred to herein as a half flow decompression distance $D_{D2}$) is different from the full flow decompression distance $D_{D1}$. Similarly, the extent to which the trapped hydraulic fluid is compressed during the decompression stage S2 in the 5% displacement operation (which is referred to herein as a 5% flow decompression distance $D_{D3}$) is also different from the full flow decompression distance $D_{D1}$ and the half flow decompression distance $D_{D2}$.

Such different compression and decompression distances for different fluid flow operations in a hydraulic piston device, as shown in FIGS. 3A-3C, can increase a chance of pressure pulsations, cavitation, and efficiency in the operation of the device. The radial piston device 100 in accordance with the present disclosure can provide an optimal timing design that allows a smooth pressure transition in the pistons reciprocating in the device. In general, the motion of the pistons reciprocating within the cylinders 128 of the rotor 106 is modified to adjust the timing at which the precompression and decompression of hydraulic fluid trapped in a cylinder chamber occur as the associated piston transitions between the pintle inlet (e.g., the fluid inlet stage S1) and the pintle outlet (e.g., the fluid outlet stage S3). The device 100 without the timing adjustment, as illustrated in FIGS. 1A-1B, leads to the motion of the piston 108 as depicted in FIGS. 3A-3C, providing different compression and decompression distances $D_{P1}$, $D_{P2}$, $D_{P3}$, $D_{D1}$, $D_{D2}$, and $D_{D3}$ during the precompression stage S2 and the decompression stage S4.

Figure 4A:
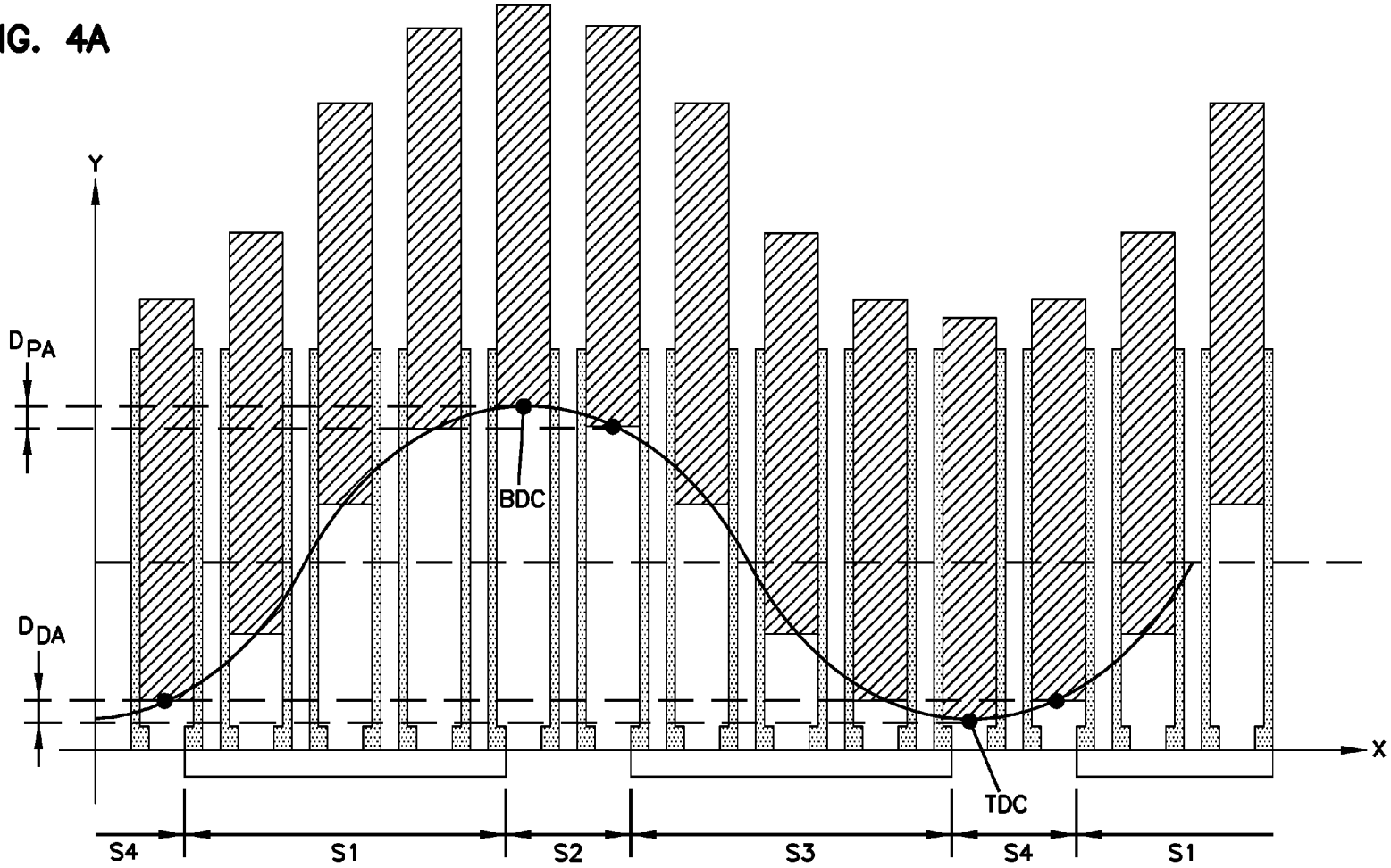
FIG. 4A illustrates an example stroke of each piston with timing adjustment in accordance with the principles of the present disclosure as the rotor rotates on the pintle shaft in a maximum displacement operation.
Figure 4B:
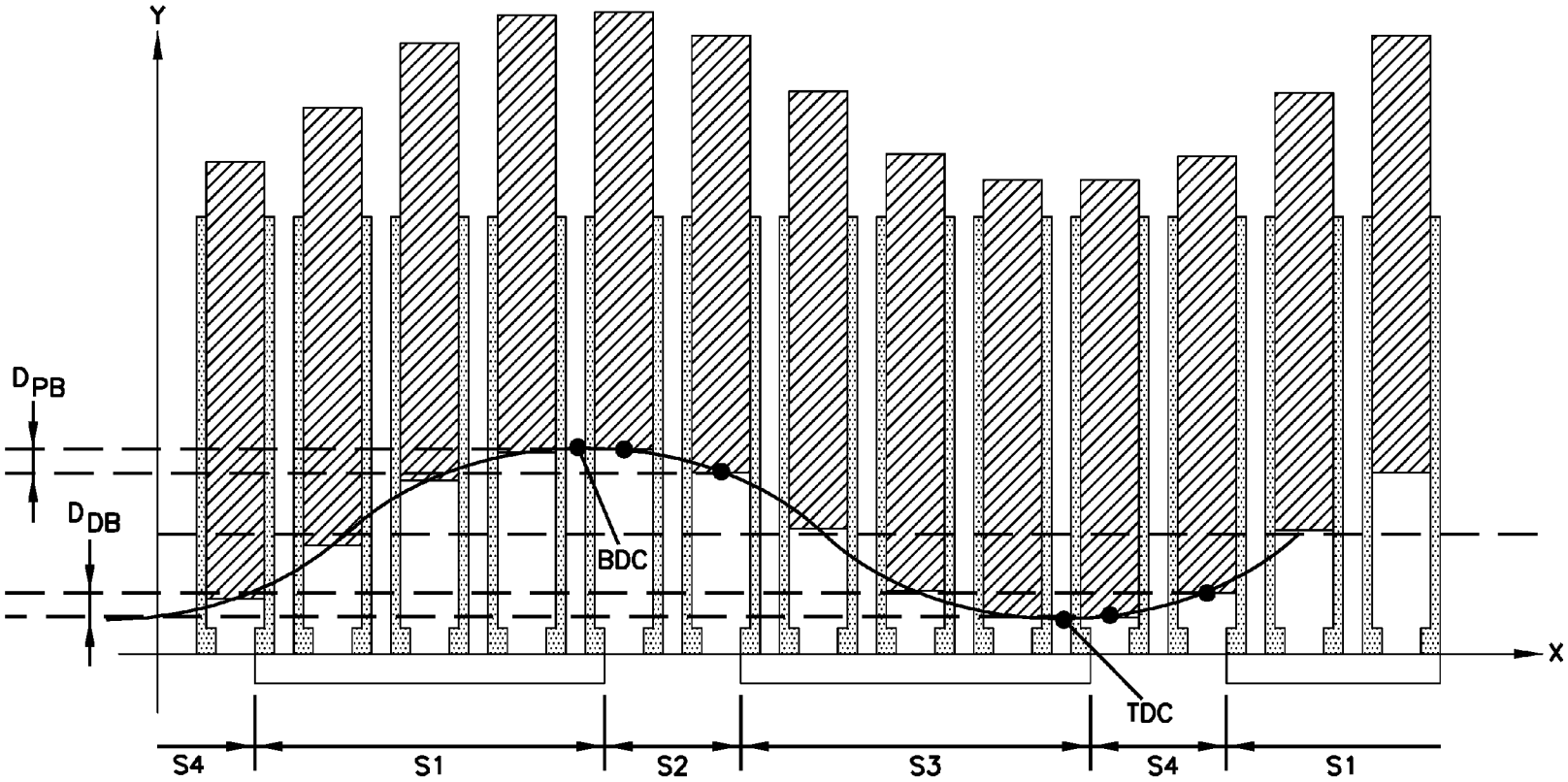
FIG. 4B illustrates an example stroke of the piston with timing adjustment in accordance with the principles of the present disclosure as the rotor rotates on the pintle shaft in a half displacement operation.
Figure 4C:
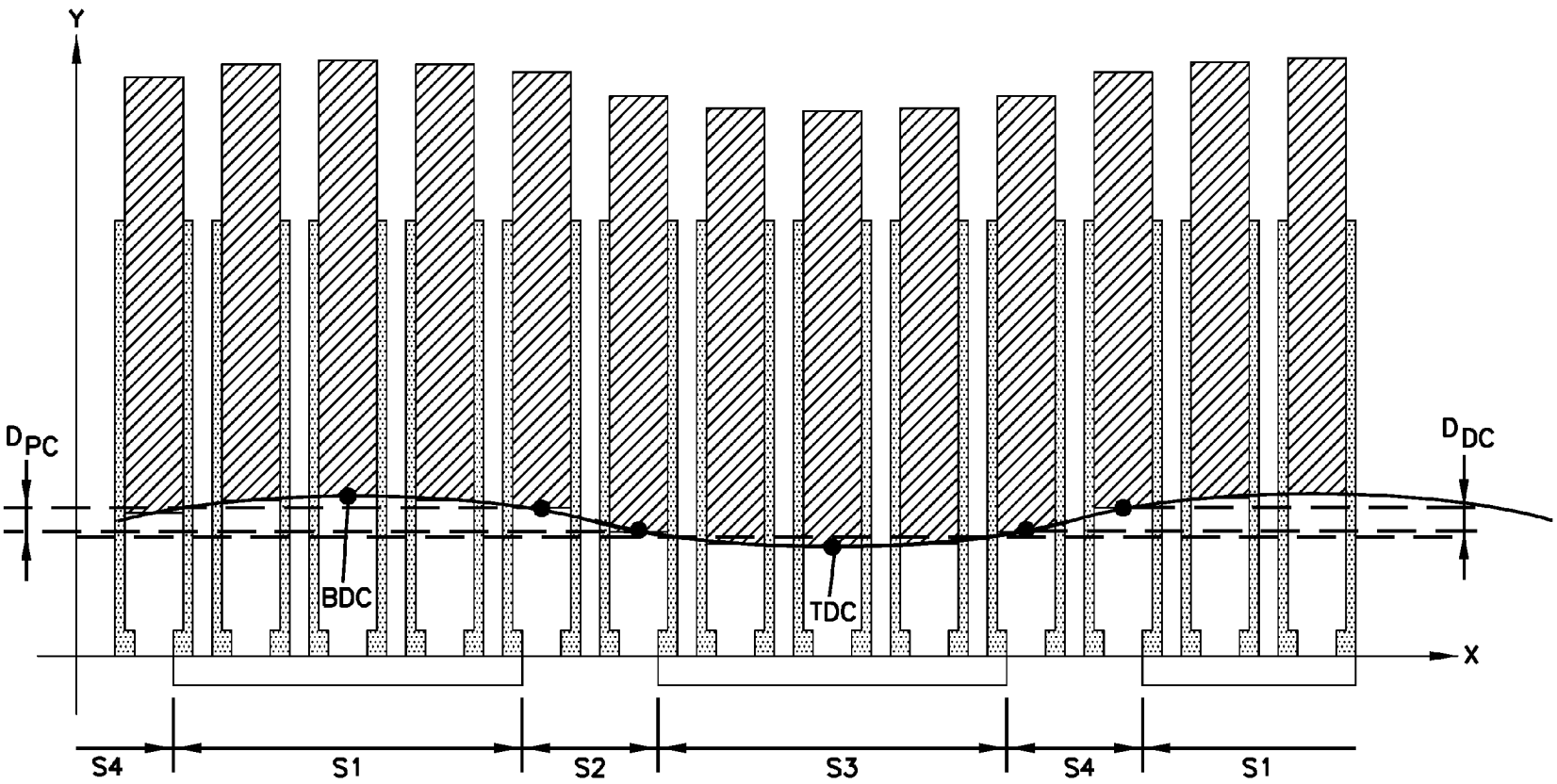
FIG. 4C illustrates an example stroke of the piston with timing adjustment in accordance with the principles of the present disclosure as the rotor rotates on the pintle shaft in a minimum displacement operation.

Referring to FIGS. 4A-4C, an example stroke of each piston 108 within an associated cylinder 128 of the rotor 106 is illustrated as the rotor 106 rotates on the pintle shaft 104 about the rotor axis of rotation $A_R$. In this example, the operational timing of the pistons 108 within the cylinders 128 is adjusted to provide a consistent compression distance and a consistent decompression distance for different flow rates of hydraulic fluid pumped in the device 100. Such an adjustment of the piston motion can reduce or eliminate several issues including pressure pulsations, cavitation, and decreased efficiency. It is noted that the graph and the relative positions of the piston 108 are somewhat exaggerated in FIGS. 4A-4C for clarity purposes.

FIG. 4A illustrates a position of each piston 108 within an associated cylinder 128 as the rotor 106 rotates on the pintle shaft 104 about the rotor axis of rotation $A_R$ when the device 100 is in a maximum displacement operation, in which the device 100 operates to pump hydraulic fluid in a full capacity. In the maximum displacement operation, the radial piston device 100 provides a maximum displacement of hydraulic fluid in each cycle (i.e., per each rotation of the 106). In the illustrated example, the timing of the stroke of the piston 108 in this modified device 100 is configured to be identical to the timing of the stroke of the piston 108 as illustrated in FIG. 3A. Accordingly, a full flow precompression distance $D_{PA}$ and a full flow decompression distance $D_{DA}$ remain the same as the full flow precompression distance $D_{P1}$ and the full flow decompression distance $D_{D1}$ in FIG. 3A, and used as reference distances with which other precompression and decompression distances in different flow rates (i.e., different displacement operations as shown in FIGS. 4B and 4C) are adjusted to accord. For example, as described below, other precompression distances (including the half flow precompression distance $D_{P2}$ and the 5% flow precompression distance $D_{P3}$) and decompression distances (including the half flow decompression distance $D_{D2}$ and the 5% flow decompression distance $D_{D3}$) are adjusted to be the same as the full flow precompression distance $D_{PA}$ and the full flow decompression distance $D_{DA}$. In other examples, another set of precompression and decompression distances can be used as reference distances.

FIG. 4B illustrates a position of the piston 108 within the cylinder 128 as the rotor 106 rotates on the pintle shaft 104 about the rotor axis of rotation $A_R$ when the device 100 is in a half displacement operation in which the device 100 operates to pump hydraulic fluid in half of its full capacity. As illustrated, the timing of the strokes of the piston 108 is shifted from the stroke of the piston 108 that is shown in FIG. 3B, such that the half flow precompression distance $D_{PB}$ is the same as the full flow precompression distance $D_{PA}$ and the half flow decompression distance $D_{DB}$ is the same as the full flow decompression distance $D_{DA}$. For example, the bottom dead center (BDC) position of the piston 108 within the cylinder 128 is not within the precompression stage S2. Instead, the BDC position of the piston 108 occurs during the fluid inlet stage S1. Similarly, the top dead center (TDC) position of the piston 108 is not within the decompression stage S4 but within the fluid outlet stage S3.

FIG. 4C illustrates a position of the piston 108 within the cylinder 128 as the rotor 106 rotates on the pintle shaft 104 about the rotor axis of rotation $A_R$ when the device 100 is in a minimum displacement operation in which the device 100 operates to pump hydraulic fluid in its minimum capacity. In the minimum displacement operation, the radial piston device 100 provides a minimum displacement of hydraulic fluid in each cycle (i.e., per each rotation of the 106). In some examples, the minimum displacement operation can provide essentially zero displacement of hydraulic fluid (i.e., the device 100 pumps no fluid). Similarly to FIG. 4B, the timing of the strokes of the piston 108 is shifted such that the zero flow precompression distance $D_{PC}$ and the zero flow decompression distance $D_{DC}$ are the same as the full flow precompression distance $D_{PA}$ and the full flow decompression distance $D_{DA}$. For example, the bottom dead center (BDC) position of the piston 108 within the cylinder 128 is not within the precompression stage S2, but occurs during the fluid inlet stage S1. The top dead center (TDC) position of the piston 108 is not within the decompression stage S4 but within the fluid outlet stage S3.

Referring to FIGS. 5A, 5B, 6A, and 6B, example hydraulic radial piston devices 100 are illustrated to implement the principles described with reference to FIGS. 4A-4C. In some examples, the ring displacement mechanism 112 is configured to offset the thrust ring 110 from the pintle shaft 104 such that an amount of compression performed by the retracting piston 108 in the precompression stage S2 and an amount of decompression performed by the extending piston 108 in the decompression stage S4 are maintained to be consistent, respectively, regardless of the different flow rates of hydraulic fluid in the radial piston device 100.

The ring displacement mechanism 112 and the thrust ring 110 are disposed around the rotor 106 within the housing 102 to offset the thrust ring axis of rotation $A_T$ from the rotor axis of rotation $A_R$ such that each of the precompression distances and the decompression distances remain constant throughout different displacement operations. In some examples, the ring displacement mechanism 112 receiving the thrust ring 110 can be arranged and operated within the housing 102 to maintain the thrust ring 110 to be offset from the rotor 106 throughout the different displacement operations between the minimum displacement operation and the maximum displacement operation. For example, the ring displacement mechanism 112 moves the thrust ring 110 between a first position and a second position within the housing 102. When the thrust ring 110 is in the first position, the radial piston device 100 provides the minimum displacement of hydraulic fluid per each rotation of the rotor 106. When the thrust ring 110 is in the second position, the radial piston device 100 provides the maximum displacement of hydraulic fluid per each rotation of the rotor 106. Throughout a range of movement between the first and second position of the thrust ring 110, the thrust ring axis of rotation $A_T$ is offset from the rotor axis of rotation $A_R$.

In some examples (e.g., FIGS. 6A and 6B), the offset reference line L3, which extends through the rotor axis of rotation $A_R$ and the thrust ring axis of rotation $A_T$ that is offset from the rotor axis of rotation $A_R$ is aligned with the first reference line L1 in the minimum displacement operation (e.g., where the thrust ring 110 is in the first position) and with the second reference line L2 in the maximum displacement operation (e.g., where the thrust ring 110 is in the second position). As described in FIG. 2, the first reference line L1 is defined as a line extending through the centers of the fluid inlet section P1 (i.e., the pintle inlet 120) and the fluid outlet section P3 (i.e., the pintle outlet 122), and the second reference line L2 is defined as a line extending through the centers of the precompression section P2 and the decompression section P4. As the ring displacement mechanism 112 gradually operates to displace the thrust ring 110 between the minimum displacement operation and the maximum displacement operation, the offset reference line L3 gradually pivots about the rotor axis of rotation $A_R$ between the first reference line L1 and the second reference line L2.

In other examples (e.g., FIGS. 5A and 5B), the offset reference line L3 is not aligned with the second reference line L2 when the thrust ring 110 is in the second position to provide the maximum displacement operation of the device 100. For example, the offset reference line L3 is aligned with the first reference line L1 when the thrust ring 110 is in the first position to provide the minimum displacement operation, and rotates about the rotor axis of rotation $A_R$ as the thrust ring 110 moves between the first and second positions within the housing 102. However, when the thrust ring 110 is in the second position, the offset reference line L3 is not aligned with the second reference line L2 and positioned between the first and second reference lines L1 and L2, as shown in FIG. 5B. In this configuration, the maximum displacement of hydraulic fluid in the device 100 can be smaller than that a maximum displacement of hydraulic fluid that would otherwise be provided by the same device 100 if the offset reference line L3 is aligned with the second reference line L2.

The offset of the thrust ring axis of rotation $A_T$ from the rotor axis of rotation $A_R$ to define the offset reference line L3 throughout different displacement operations shifts the timing of each piston 108 to reach its bottom dead center (BDC) position while the associated rotor fluid port 134 is in fluid communication with the pintle inlet 120 (i.e., while the piston 108 is in the fluid inlet stage S1, as illustrated in FIG. 4A). Similarly, this offset also shifts the timing of each piston 108 to reach its top dead center (TDC) position while the rotor fluid port 134 is in fluid communication with the pintle outlet 122 (i.e., while the piston 108 is in the fluid outlet stage S3, as illustrated in FIG. 4A). As such, the timing of the motion of the piston 108 is adjusted from the one as illustrated in FIGS. 1 and 3.

Figure 5A:
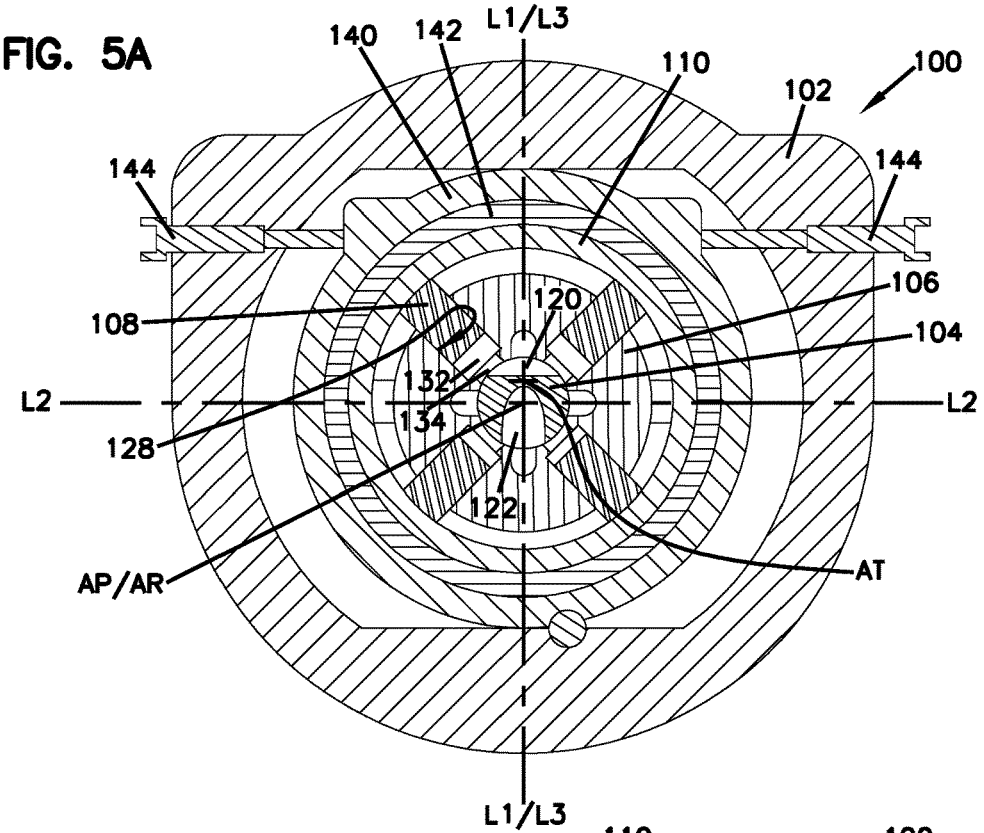
FIG. 5A illustrates an example hydraulic radial piston device in the minimum displacement operation with timing offset in accordance with the principles of the present disclosure.
Figure 5B:
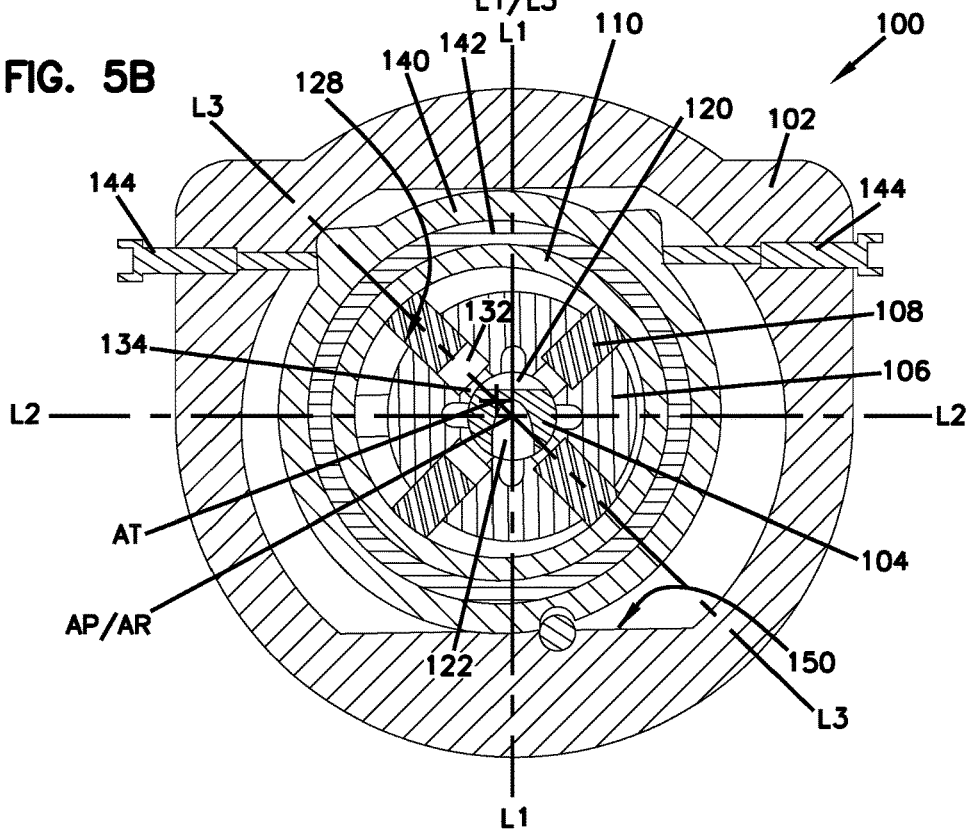
FIG. 5B illustrates the hydraulic radial piston device of FIG. 5A in the maximum displacement operation.

Referring to FIGS. 5A and 5B, an example radial piston device 100 with the timing offset as illustrated in FIGS. 4A-4C in accordance with the present disclosure is described. The radial piston device 100 in this example is configured similarly to the device 100 as described in FIGS. 1A and 1B except for the orientation of the pintle shaft 104 and the position of the thrust ring 110. As many of the concepts and features are similar to the device 100 shown in FIGS. 1A and 1B, the description for the device 100 as described in FIGS. 1A and 1B is hereby incorporated by reference for the example device 100 of FIGS. 5A and 5B. Where like or similar features or elements are shown, the same reference numbers will be used where possible. The following description for the device 100 in this example will be limited primarily to the differences between the device 100 of FIGS. 1A and 1B and the device 100 of FIGS. 5A and 5B.

Similarly to the device 100 as described in FIGS. 1A and 1B, the control device 144 of the ring displacement mechanism 112 operates to move the cam ring 140 engaging the thrust ring 110 therein between a first position (FIG. 5A) and a second position (FIG. 5B) within the housing 102. The control device 144 can roll the cam ring 140 on the inner surface 150 of the housing 102 such that the thrust ring axis of rotation $A_T$ moves in parallel with the inner surface 150 between the first and second positions.

Further, the ring displacement mechanism 112 is disposed within the housing 102 such that the thrust ring axis of rotation $A_T$ remains offset from the rotor axis of rotation $A_R$ throughout different displacement operations (i.e., different flow rates) of the device 100. As described below, when the thrust ring 110 is in the first position for providing the minimum displacement of fluid, the offset reference line L3 extending through the thrust ring axis of rotation $A_T$ and the rotor axis of rotation $A_R$ is aligned with the first reference line L1. When the thrust ring 110 is in the second position to provide the maximum displacement of fluid, the offset reference line L3 can be positioned between the first reference line L1 and the second reference line L2. In particular, the ring displacement mechanism 112 can adjust a position of the thrust ring 110 within the housing 102 between the first and second positions such that the offset reference line L3 pivots about the rotor axis of rotation $A_R$ as the thrust ring 110 is moved through the range of movement. In this operation, a decompression value (e.g., decompression distances $D_{D1}$, $D_{D2}$ and $D_{D3}$) that occurs within the cylinders 128 as the rotor fluid ports 134 move across the decompression section S4 remains constant as the thrust ring 110 moves through the range of movement, and a compression value (e.g., precompression distances $D_{P1}$, $D_{P2}$ and $D_{P3}$) that occurs within the cylinders 128 as the rotor fluid ports 134 move across the precompression section S2 remains constant as the thrust ring 110 moves through the range of movement.

As shown in FIG. 5A, the hydraulic radial piston device 100 is in the minimum displacement operation, in which the device 100 operates to pump a minimum volume of hydraulic fluid therethrough. In some examples, the device 100 operates to pump no fluid in the minimum displacement operation. In the minimum displacement operation, the thrust ring 110 is arranged in the first position while the thrust ring axis of rotation $A_T$ is offset from the rotor axis of rotation $A_R$. In this example, the pintle shaft 104 is arranged such that the pintle inlet 120 and the pintle outlet 122 (i.e., the fluid inlet section P1 and the fluid outlet section P3) are aligned with the offset reference line L3 when the thrust ring 110 is in the first position (i.e., in the minimum displacement operation). In other words, the offset reference line L3 is aligned with the reference line L1 in the first position.

As shown in FIG. 5B, the hydraulic radial piston device 100 is in the maximum displacement operation, in which the device 100 operates to pump in its maximum capacity. In the maximum displacement operation, the thrust ring 110 is arranged in the second position while the thrust ring axis of rotation $A_T$ is offset from the rotor axis of rotation $A_R$. In the second position, the offset reference line L3 is arranged between the first reference line L1 and the reference line L2.

The ring displacement mechanism 112 can operate to move the thrust ring 110 to different positions between the first and second positions to produce different amounts of displacement (i.e., flow rates of hydraulic fluid) while maintaining an offset between the thrust ring axis of rotation $A_T$ and the rotor axis of rotation $A_R$. In particular, the ring displacement mechanism 112 operates to roll the thrust ring 110 on the inner surface 150 to pivot the offset reference line L3 about the rotor axis of rotation $A_R$ (and the pintle axis $A_P$) between the first and second positions. In this configuration, as the thrust ring 110 rolls on the inner surface 150 of the housing 102, the thrust ring axis of rotation $A_T$ moves in parallel with the inner surface 150 of the housing 102 while being offset from the rotor axis of rotation $A_R$.

Figure 6A:
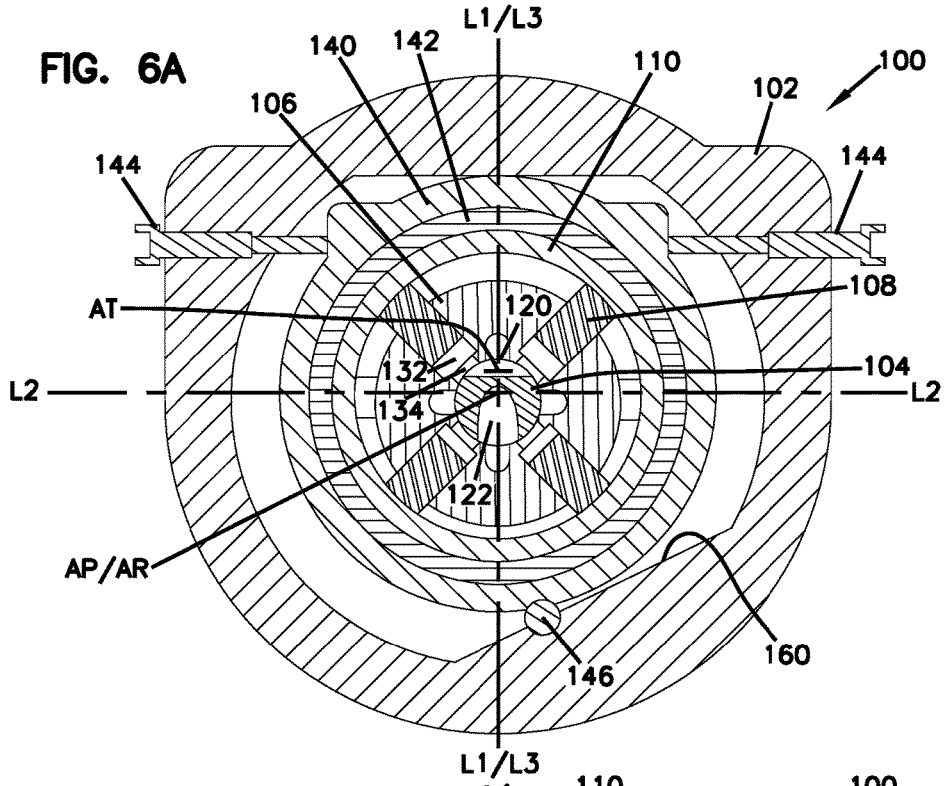
FIG. 6A illustrates another example hydraulic radial piston device in the minimum displacement operation with timing offset in accordance with the principles of the present disclosure.
Figure 6B:
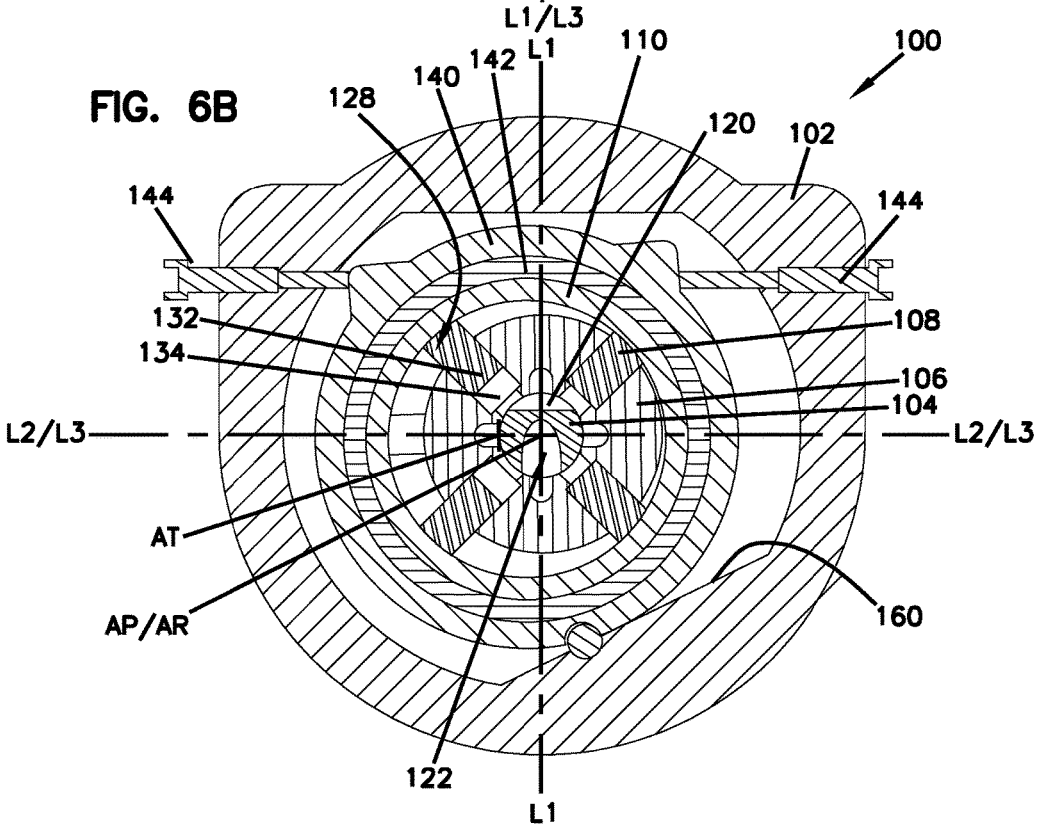
FIG. 6B illustrates the hydraulic radial piston device of FIG. 6A in the maximum displacement operation.

Referring to FIGS. 6A and 6B, another example radial piston device 100 with the timing offset as illustrated in FIGS. 4A-4C in accordance with the present disclosure is described. The radial piston device 100 in this example is configured similarly to the device 100 as described in FIGS. 1A and 1B except for a sliding structure (e.g., the inner surface 150) of the housing 102 on which the cam ring 140 moves. As many of the concepts and features are similar to the device 100 shown in FIGS. 1A and 1B, the description for the device 100 as described in FIGS. 1A and 1B is hereby incorporated by reference for the example device 100 of FIGS. 6A and 6B. Where like or similar features or elements are shown, the same reference numbers will be used where possible. The following description for the device 100 in this example will be limited primarily to the differences between the device 100 of FIGS. 1A and 1B and the device 100 of FIGS. 6A and 6B.

Similarly to the device 100 as illustrated in FIGS. 5A and 5B, the ring displacement mechanism 112 is configured to maintain an offset between the thrust ring axis of rotation $A_T$ and the rotor axis of rotation $A_R$ throughout different displacement operations of the device 100. The ring displacement mechanism 112 operates to move the cam ring 140 engaging the thrust ring 110 therein between a first position (FIG. 6A) and a second position (FIG. 6B) within the housing 102. For example, the offset reference line L3 defined by the thrust ring axis of rotation $A_T$ and the rotor axis of rotation $A_R$ is vertically arranged in the first position as shown in FIG. 6A, and horizontally arranged in the second position as shown in FIG. 6B.

In this example, the inner surface 150 of the housing 102 is tilted to define a ramp surface 160 on which the cam ring 140 rolls. The ramp surface 160 is tilted, compared to the inner surface 150, to allow the cam ring 140 to roll between the first position (FIG. 6A) and the second position (FIG. 6B). As the control device 144 moves the cam ring 140 on the ramp surface 160, the thrust ring axis of rotation $A_T$ moves in parallel with the ramp surface 160 while being offset from the rotor axis of rotation $A_R$. As described below, the offset reference line L3 extending through the thrust ring axis of rotation $A_T$ and the rotor axis of rotation $A_R$ is aligned with the first reference line L1 in the minimum displacement operation, and with the second reference line L2 in the maximum displacement operation.

As shown in FIG. 6A, the hydraulic radial piston device 100 is in the minimum displacement operation, in which the device 100 operates to pump a minimum volume of hydraulic fluid therethrough. In some examples, the device 100 operates to pump no fluid in the minimum displacement operation. In the minimum displacement operation, the thrust ring 110 is arranged in the first position while the thrust ring axis of rotation $A_T$ is offset from the rotor axis of rotation $A_R$. In this example, the pintle shaft 104 is arranged similarly to the pintle shaft 104 as illustrated in FIGS. 1A and 1B so that the first reference line L1 extending through the pintle inlet 120 and the pintle outlet 122 (i.e., the fluid inlet section P1 and the fluid outlet section P3) is oriented vertically and the second reference line L2 is oriented horizontally, when viewed in FIGS. 6A and 6B. Accordingly, when the thrust ring 110 is in the first position for the minimum displacement operation, the offset reference line L3 is arranged vertically and aligned with the first reference line L1.

As shown in FIG. 6B, the hydraulic radial piston device 100 is in the maximum displacement operation, in which the device 100 operates to pump in its maximum capacity. In the maximum displacement operation, the thrust ring 110 is arranged in the second position while the thrust ring axis of rotation $A_T$ is offset from the rotor axis of rotation $A_R$. In the second position, the offset reference line L3 is arranged horizontally and aligned with the reference line L2, which passes the precompression section P2 and the decompression section P4.

The ring displacement mechanism 112 can operate to move the thrust ring 110 to different positions between the first and second positions to produce different amounts of displacement (i.e., flow rates of hydraulic fluid) while maintaining an offset between the thrust ring axis of rotation $A_T$ and the rotor axis of rotation $A_R$. As the thrust ring 110 moves between the first and second positions, the thrust ring axis of rotation $A_T$ can move in parallel with the ramp surface 160 of the housing 102 while being offset from the rotor axis of rotation $A_R$.

Figure 7:
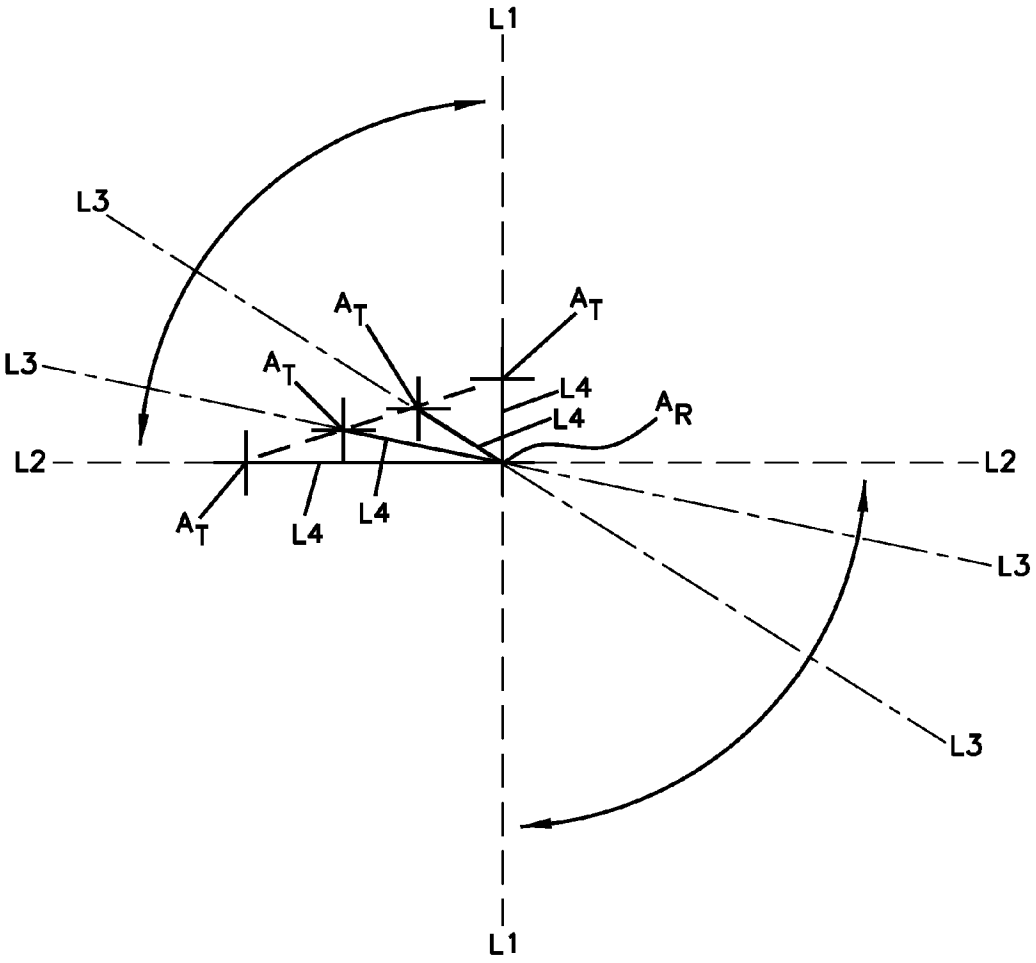
FIG. 7 illustrates a movement of a thrust ring axis of rotation relative to a rotor axis of rotation through a range of movement of a thrust ring relative to a rotor for different displacements operation.

As described above, the offset between the rotor axis of rotation and the thrust ring axis of rotation defines an eccentricity reference line L4 (FIG. 7). The eccentricity reference line L4 is aligned with the offset reference line L3 through a range of movement of the thrust ring 110 within the housing 102 between the first position (i.e., where the offset reference line L3 is aligned with the first reference line L1) and the second position (i.e., where the offset reference line L3 is aligned with the second reference line L2 or arranged between the first and second reference lines L1 and L2). The ring displacement mechanism 112 is operated to move the thrust ring 110 through the range of movement within the housing 102 such that the eccentricity reference line L4 rotates about the rotor axis of rotation $A_R$.

As the position of the thrust ring 110 is adjusted along the range of movement between the first and second positions, a volume of hydraulic fluid displaced by the radial piston device 100 per each rotation of the rotor 106 is adjusted between the minimum displacement operation and the maximum displacement operation. As shown in FIG. 7, this adjustment is achieved by moving the thrust ring axis of rotation $A_T$ further from the rotor axis or rotation $A_R$ as the thrust ring 110 is moved toward the second position for the maximum displacement operation, and by moving the thrust ring axis of rotation $A_T$ closer from to rotor axis or rotation $A_R$ as the thrust ring is moved toward the first position for the minimum displacement operation.

Accordingly, as shown in FIGS. 5 and 6, the stroke length curve defined by the movement of the pistons within the associated cylinders is shifted relative to the fluid inlet section, the fluid outlet section, the fluid precompression section, and the fluid decompression section of the pintle shaft as the thrust ring is moved along the range of movement within the housing (i.e., as the eccentricity reference line L4 rotates about the rotor axis of rotation $A_R$ with the variation in the distance between the thrust ring axis of rotation $A_T$ and the rotor axis of rotation $A_R$). In some examples, the stroke length curve is shifted such that a distance (e.g., the precompression distance $D_{PA}$, $D_{PB}$, and $D_{PC}$) of movement of the pistons 108 within the cylinders 128 as the rotor fluid ports 134 move across the fluid precompression section S2 remains substantially constant as the thrust ring 110 is moved through the range of movement, and a distance (e.g., the decompression distance $D_{DA}$, $D_{DB}$, and $D_{DC}$) of movement of pistons 108 within the cylinders 128 as the rotor fluid ports 134 move across the fluid decompression section S4 remains substantially constant as the thrust ring 110 is moved through the range of movement.

The various examples and teachings described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A hydraulic radial piston device comprising:

a housing having a hydraulic fluid inlet and a hydraulic fluid outlet;

a pintle shaft fixed within the housing, the pintle shaft defining a pintle inlet and a pintle outlet, the pintle inlet being in fluid communication with the hydraulic fluid inlet, and the pintle outlet being in fluid communication with the hydraulic fluid outlet;

a rotor mounted on the pintle shaft and configured to rotate relative to the pintle shaft about a rotor axis of rotation, the rotor axis of rotation extending through a length of the pintle shaft, the rotor defining a plurality of radially oriented cylinders and a plurality of rotor fluid ports, each of the plurality of rotor fluid ports being in fluid communication with at least one of the plurality of radially oriented cylinders and being alternatively in fluid communication with either the pintle inlet or the pintle outlet as the rotor rotates relative to the pintle shaft about the rotor axis of rotation;

a plurality of pistons received in the plurality of radially oriented cylinders, respectively;

a thrust ring disposed about the rotor and having a thrust ring axis of rotation, the thrust ring being in contact with the plurality of pistons and configured to rotate about the thrust ring axis of rotation as the rotor rotates relative to the pintle shaft about the rotor axis of rotation; and a ring displacement driver operable to move the thrust ring through a range of movement within the housing between a first position in which the radial piston device has a minimum displacement of hydraulic fluid per each rotation of the rotor and a second position in which the radial piston device has a maximum displacement of hydraulic fluid per each rotation of the rotor, the ring displacement driver operating to maintain the thrust ring axis of rotation in offset relation relative to the rotor axis of rotation such that a precompression stroke distance and a decompression stroke distance of each of the plurality of pistons remain consistent, respectively, regardless of a position of the thrust ring in the range of movement of the thrust ring within the housing, thereby providing a smooth pressure transition in the each of the plurality of radially oriented cylinders.

2. The hydraulic radial piston device according to claim 1, wherein the pintle inlet and the pintle outlet are spaced apart 180 degrees around the pintle shaft to define a first reference line extending through the pintle inlet and the pintle outlet and intersecting the rotor axis of rotation.

3. The hydraulic radial piston device according to claim 2, further comprising an offset reference line extending through the rotor axis of rotation and the thrust ring axis of rotation, the offset reference line being aligned with the first reference line when the thrust ring is in the first position.

4. The hydraulic radial piston device according to claim 3, wherein the offset reference line that intersects the rotor axis of rotation and the thrust ring axis of rotation rotates about the rotor axis of rotation as the thrust ring is moved through the range of movement.

5. The hydraulic radial piston device according to claim 1, wherein:

the pintle shaft has an outer circumferential surface defining a fluid inlet section, a fluid precompression section, a fluid outlet section, and a fluid decompression section, the fluid inlet section defined by the pintle inlet, the fluid outlet section defined by the pintle outlet, the precompression section defined as a region between the fluid inlet section and the fluid outlet section, and the decompression section defined as a region between the fluid outlet section and the fluid inlet section and opposite to the precompression section;

each of the plurality of rotor fluid ports moves on the outer circumferential surface of the pintle shaft to pass the fluid inlet section, the fluid precompression section, the fluid outlet section, and the fluid decompression section as the rotor rotates relative to the pintle shaft about the rotor axis of rotation;

the fluid inlet section and the fluid outlet section are arranged to be oppositely positioned about the rotor axis of rotation to define a first reference line extending through the fluid inlet section and the fluid outlet section and intersecting the rotor axis of rotation; and the precompression section and the decompression section are arranged to be oppositely positioned about the rotor axis of rotation to define a second reference line extending through the precompression section and the decompression section and intersecting the rotor axis of rotation.

6. The hydraulic radial piston device according to claim 5, wherein the first reference line is perpendicular to the second reference line.

7. The hydraulic radial piston device according to claim 5, further comprising an offset reference line extending through the rotor axis of rotation and the thrust ring axis of rotation, the offset reference line being aligned with the first reference line when the thrust ring is in the first position and with the second reference line when the thrust ring is in the second position.

8. The hydraulic radial piston device according to claim 7, wherein the ring displacement driver is configured to adjust a position of the thrust ring within the housing between the first and second positions such that the offset reference line pivots about the rotor axis of rotation as the thrust ring is moved through the range of movement, wherein a decompression value that occurs within the cylinders as the rotor fluid ports move across the decompression section remains constant as the thrust ring moves through the range of movement, and wherein a compression value that occurs within the cylinders as the rotor fluid ports move across the precompression section remains constant as the thrust ring moves through the range of movement.

9. The hydraulic radial piston device according to claim 1, wherein the ring displacement driver comprises a cam ring configured to at least partially receive and rotatably support the thrust ring, and a control element engageable with the cam ring and operable to adjust a position of the cam ring within the housing.

10. The hydraulic radial piston device according to claim 9, wherein:

the housing includes an inner cam supporting surface; and the control element is configured to move the cam ring along the inner cam supporting surface such that the thrust ring axis of rotation moves in parallel with the inner cam supporting surface while being offset from the rotor axis of rotation.

11. The hydraulic radial piston device according to claim 10, wherein the inner cam supporting surface of the housing is tilted to define a ramp surface on which the cam ring moves such that the thrust ring axis of rotation moves in parallel with the ramp surface while being offset from the rotor axis of rotation.

12. A hydraulic radial piston device comprising:

a housing having a hydraulic fluid inlet and a hydraulic fluid outlet;

a pintle shaft fixed within the housing, the pintle shaft having an outer circumferential surface defining a fluid inlet section, a fluid precompression section, a fluid outlet section, and a fluid decompression section, the pintle shaft including a pintle inlet defined in the fluid inlet section and a pintle outlet defined in the fluid outlet section, the pintle inlet being in fluid communication with the hydraulic fluid inlet, and the pintle outlet being in fluid communication with the hydraulic fluid outlet;

a rotor mounted on the pintle shaft and configured to rotate relative to the pintle shaft about a rotor axis of rotation, the rotor axis of rotation extending through a length of the pintle shaft, the rotor defining a plurality of radially oriented cylinders and a plurality of rotor fluid ports, each of the plurality of rotor fluid ports being in fluid communication with at least one of the plurality of radially oriented cylinders and moving on the outer circumferential surface of the pintle shaft to pass the fluid inlet section, the fluid precompression section, the fluid outlet section, and the fluid decompression section as the rotor rotates relative to the pintle shaft about the rotor axis of rotation;

a plurality of pistons received in the plurality of radially oriented cylinders, respectively;

a thrust ring disposed about the rotor and having a thrust ring axis of rotation, the thrust ring being in contact with the plurality of pistons and configured to rotate about the thrust ring axis of rotation as the rotor rotates relative to the pintle shaft about the rotor axis of rotation; and a ring displacement driver operable to displace the thrust ring through a range of movement within the housing between a first position in which the radial piston device provides a minimum displacement of hydraulic fluid per each rotation of the rotor and a second position in which the radial piston device provides a maximum displacement of hydraulic fluid per each rotation of the rotor, wherein, when the each of the plurality of rotor fluid ports passes the fluid inlet section, each of the plurality of rotor fluid ports is in fluid communication with the pintle inlet at the fluid inlet section to draw hydraulic fluid into one or more cylinders associated with the rotor fluid port through the pintle inlet;

wherein, when the each of the plurality of rotor fluid ports passes the fluid precompression section, each of the plurality of rotor fluid ports is closed to trap and compress the hydraulic fluid within the cylinders at the fluid precompression section;

wherein, when the each of the plurality of rotor fluid ports passes the fluid outlet section, the each of the plurality of rotor fluid ports is in fluid communication with the pintle outlet at the fluid outlet section to discharge the hydraulic fluid from the cylinders through the pintle outlet; and wherein, when the each of the plurality of rotor fluid ports passes the fluid decompression section, the each of the plurality of rotor fluid ports is closed to decompress the cylinders at the fluid decompression section, wherein an eccentricity reference line defined through the rotor axis of rotation and the thrust ring axis of rotation rotates about the rotor axis of rotation as the thrust ring is moved through the range of movement such that the thrust ring axis of rotation remains in offset relation relative to the rotor axis of rotation to provide a consistent precompression stroke distance and a consistent decompression stroke distance of each of the plurality of pistons regardless of a position of the thrust ring in the range of movement of the thrust ring within the housing, thereby providing a smooth pressure transition in the each of the plurality of radially oriented cylinders, wherein adjustment of a position of the thrust ring along the range of movement adjusts a volume of hydraulic fluid displaced by the radial piston device for each rotation of the rotor by moving the thrust ring axis of rotation further from the rotor axis of rotation as the thrust ring is moved toward the second position so as to increase a stroke length of the pistons within the cylinders, and by moving the thrust ring axis of rotation closer to the rotor axis of rotation as the thrust ring is moved toward the first position so as to decrease a stroke length of the pistons within the cylinders.

13. The hydraulic radial piston device according to claim 12, wherein movement of the pistons within the cylinders define a stroke length curve corresponding to one full rotation of the rotor, and wherein movement of the thrust ring along the range of movement shifts the stroke length curve relative to the fluid inlet section, the fluid outlet section, the fluid precompression section, and the fluid decompression section of the pintle shaft.

14. The hydraulic radial piston device according to claim 12, wherein:

the fluid inlet section and the fluid outlet section are arranged to be oppositely positioned about the rotor axis of rotation to define a first reference line extending through the fluid inlet section and the fluid outlet section and intersecting the rotor axis of rotation;

the fluid precompression section and the fluid decompression section are arranged to be oppositely positioned about the rotor axis of rotation to define a second reference line extending through the precompression section and the decompression section and intersecting the rotor axis of rotation; and the first reference line is perpendicular to the second reference line.

15. The hydraulic radial piston device according to claim 14, further comprising an offset reference line extending through the rotor axis of rotation and the thrust ring axis of rotation, the offset reference line being aligned with the first reference line when the thrust ring is in the first position and with the second reference line when the thrust ring is in the second position.

16. The hydraulic radial piston device according to claim 15, wherein the ring displacement driver is configured to adjust a position of the thrust ring within the housing between the first and second positions such that the offset reference line pivots about the rotor axis of rotation as the thrust ring is moved through the range of movement, wherein a decompression value that occurs within the cylinders as the rotor fluid ports move across the decompression section remains constant as the thrust ring moves through the range of movement, and wherein a compression value that occurs within the cylinders as the rotor fluid ports move across the precompression section remains constant as the thrust ring moves through the range of movement.

17. The hydraulic radial piston device according to claim 12, wherein the ring displacement driver comprises a cam ring configured to at least partially receive and rotatably support the thrust ring, a control element operable to adjust a position of the cam ring within the housing.

18. The hydraulic radial piston device according to claim 17, wherein:

the housing includes an inner cam supporting surface; and the control element is configured to move the cam ring along the inner cam supporting surface such that the thrust ring axis of rotation moves in parallel with the inner cam supporting surface while being offset from the rotor axis of rotation.

19. The hydraulic radial piston device according to claim 18, wherein the inner cam supporting surface of the housing is tilted to define a ramp surface on which the cam ring moves such that the thrust ring axis of rotation moves in parallel with the ramp surface while being offset from the rotor axis of rotation.

20. A hydraulic radial piston device comprising:

a housing having a hydraulic fluid inlet and a hydraulic fluid outlet;

a pintle shaft fixed within the housing, the pintle shaft defining a pintle inlet and a pintle outlet, the pintle inlet being in fluid communication with the hydraulic fluid inlet, and the pintle outlet being in fluid communication with the hydraulic fluid outlet;

a rotor mounted on the pintle shaft and configured to rotate relative to the pintle shaft about a rotor axis of rotation, the rotor axis of rotation extending through a length of the pintle shaft, the rotor defining a plurality of radially oriented cylinders and a plurality of rotor fluid ports, each of the plurality of rotor fluid ports being in fluid communication with at least one of the plurality of radially oriented cylinders and being alternatively in fluid communication with either the pintle inlet or the pintle outlet as the rotor rotates relative to the pintle shaft about the rotor axis of rotation;

a plurality of pistons received in the plurality of radially oriented cylinders, respectively;

a thrust ring disposed about the rotor and having a thrust ring axis of rotation, the thrust ring being in contact with the plurality of pistons and configured to rotate about the thrust ring axis of rotation as the rotor rotates relative to the pintle shaft about the rotor axis of rotation; and a ring displacement driver configured to displace the thrust ring into different positions within the housing between a first position in which the radial piston device is in a minimum displacement operation and a second position in which the radial piston device is in a maximum displacement operation, to produce different flow rates of the hydraulic fluid, wherein, when the thrust ring is in a position other than the minimum displacement position, the ring displacement driver displaces the thrust ring to offset the thrust ring axis of rotation from the rotor axis of rotation such that each of the plurality of pistons radially reciprocates within the associated cylinder and repeatedly passes through a cycle of a fluid inlet stage, a compression stage, a fluid outlet stage, and a decompression stage as the rotor rotates relative to the pintle shaft about the rotor axis of rotation, wherein, in the fluid inlet stage, the associated piston extends within the associated cylinder to draw a hydraulic fluid from the pintle inlet into a chamber defined within the associated cylinder when the associated rotor fluid port is in fluid communication with the pintle inlet; in the compression stage, the associated piston retracts within the associated cylinder to compress the hydraulic fluid within the chamber as the associated rotor fluid port slides on an outer surface of the pintle shaft from the pintle inlet to the pintle outlet; in the fluid outlet stage, the associated piston continues to retract within the associated cylinder to discharge the hydraulic fluid from the chamber to the pintle outlet when the associated rotor fluid port is in fluid communication with the pintle outlet; and, in the decompression stage, the associated piston extends within the associated cylinder to decompress the hydraulic fluid as the associated rotor fluid port slides on the outer surface of the pintle shaft from the pintle outlet to the pintle inlet;

wherein the ring displacement driver operates to maintain the thrust ring in offset relation from the pintle shaft such that each of an amount of precompression stoke performed by each of the plurality of pistons retracting in the precompression stage and an amount of decompression stroke performed by the each of the plurality of pistons extending in the decompression stage is maintained to be consistent regardless of a position of the thrust ring offset from the pintle shaft, thereby providing a smooth pressure transition in the each of the plurality of radially oriented cylinders.

21. The hydraulic radial piston device according to claim 20, wherein the thrust ring is arranged within the housing such that the thrust ring axis of rotation remains offset from the rotor axis of rotation as the thrust ring is adjusted between the first and second positions.

* * * * *